US011761314B2

(12) United States Patent
Schroit et al.

(10) Patent No.: US 11,761,314 B2
(45) Date of Patent: Sep. 19, 2023

(54) BOTTOM HOLE ASSEMBLY INCLUDING A MULTI-STAGE RECIPROCATING AND AUTOMATICALLY RESET PUMP

(71) Applicants: Sam Schroit, Houston, TX (US); Jeffrey Wensrich, Houston, TX (US)

(72) Inventors: Sam Schroit, Houston, TX (US); Jeffrey Wensrich, Houston, TX (US)

( * ) Notice: Subject to any disclaimer, the term of this patent is extended or adjusted under 35 U.S.C. 154(b) by 591 days.

(21) Appl. No.: 16/499,259

(22) PCT Filed: Mar. 30, 2018

(86) PCT No.: PCT/US2018/025559
§ 371 (c)(1),
(2) Date: Sep. 28, 2019

(87) PCT Pub. No.: WO2018/183955
PCT Pub. Date: Oct. 4, 2018

(65) Prior Publication Data

US 2020/0102805 A1 Apr. 2, 2020

Related U.S. Application Data

(60) Provisional application No. 62/479,674, filed on Mar. 31, 2017.

(51) Int. Cl.

| | |
|---|---|
| ***E21B 33/127*** | (2006.01) |
| ***F04B 9/109*** | (2006.01) |
| ***F04B 9/105*** | (2006.01) |
| ***F04B 17/03*** | (2006.01) |
| ***F04B 47/00*** | (2006.01) |

(52) U.S. Cl.
CPC ..... *E21B 33/1275* (2013.01); *F04B 9/105* (2013.01); *F04B 17/03* (2013.01); *F04B 47/00* (2013.01)

(58) Field of Classification Search
CPC ..... E21B 33/12; E21B 33/1275; F04B 9/105; F04B 9/109
See application file for complete search history.

(56) References Cited

U.S. PATENT DOCUMENTS

| | | | | |
|---|---|---|---|---|
| 7,878,244 | B2 * | 2/2011 | Nold, III | E21B 49/10 166/264 |
| 8,591,200 | B2 * | 11/2013 | Marica | F04B 47/00 417/388 |
| 10,190,389 | B2 * | 1/2019 | Bane | E21B 23/06 |
| 10,920,587 | B2 * | 2/2021 | Yuratich | E21B 49/10 |
| 2015/0285042 | A1 * | 10/2015 | Porel | E21B 43/128 417/399 |

* cited by examiner

*Primary Examiner* — Kenneth L Thompson

(57) ABSTRACT

Automated systems are disclosed that enable the rapid provision of fluids to downhole isolation tools. This is achieved by automatically optimizing the use of power available downhole by providing a high flowrate when pressure demand is low and a lower flowrate when pressure demand is high. Methods are disclosed which utilize the apparatus in a bottom hole assembly during downhole operations for isolating segments of a borehole.

25 Claims, 27 Drawing Sheets

BOTTOM HOLE ASSEMBLY INCLUDING A MULTI-STAGE RECIPROCATING AND AUTOMATICALLY RESET PUMP

CROSS-REFERENCE TO RELATED APPLICATIONS

This application claims the benefit of Patent Cooperation Treaty Patent Application No. PCT/US18/25559 filed on Mar. 30, 2018 claiming priority of U.S. Provisional Patent Application Ser. No. 62/479,674 filed on Mar. 31, 2017 both applications being incorporated by reference herein.

BACKGROUND

The present disclosure relates to a bottom hole assembly and a downhole tool including a reciprocating pump which facilitates isolation of a subterranean formation surrounding a downhole tubular.

A bottom hole assembly is an apparatus that is adapted for use within a borehole that extends into the earth to reach a target subterranean formation that is expected to contain valuable hydrocarbons, such as oil, gas and combinations thereof. A bottom hole assembly may be run into an existing borehole on a wireline that may provide a physical tether as well as providing connections for electrical power delivery and data communication between the bottom hole assembly and a computer system at the surface near the borehole. Furthermore, a bottom hole assembly may include one or more downhole tools, components or subsystems that perform one or more functions of the bottom hole assembly.

Certain downhole tools may include a reciprocating pump. A reciprocating pump may be activated to actuate pistons within a downhole tool or bottom hole assembly to perform various functions of a downhole tool or a bottom hole assembly.

Certain downhole tools may include an isolation device and certain BHAs may include an isolation tool.

A bottom hole assembly (BHA), including a downhole tool that includes a reciprocating pump and an isolation tool, may be deployed within the borehole, such that the isolation tool receives fluid pressure from the pump and may be inflated at various locations within the borehole. In this manner, the bottom hole assembly may be used to isolate portions of the borehole for water-shut off, pressure isolation, sand isolation; or in conjunction with a formation fracturing process, formation treatment process, other processes, or other downhole operations.

Isolation downhole tools require a range of fluid pressures to adequately set within a borehole. During the inflation of an isolation tool, a low pressure may be required to expand and contact the borehole; for example, less than 200 psi. Depending on the operational objective of an isolation tool installation in a borehole, the final set pressure, a high pressure, may be as much as 5,000 psi or greater. Additionally, depending on volume and inflation flowrates, the final set may require over one hour to achieve.

SUMMARY

A downhole tool with a reciprocating pump used to inflate an isolation tool may have difficulty utilizing its available power during both the low pressure and high-pressure periods of the downhole inflation operation. By incorporating a multi-stage reciprocating pump, when the isolation tool requires low pressure to inflate to contact the borehole for example, the pump may provide high flow. When the isolation tool requires high pressure at the end or later stages of the inflation process, the pump may provide a higher pressure at a lower flow rate.

Furthermore, a bottom hole assembly or reciprocating pump downhole tool is provided to enable an automatic reduction of the inflation flowrate upon an isolation tool or a fluid communication passage to an isolation tool, reaching a setpoint pressure. Additionally, the bottom hole assembly or reciprocating pump downhole tool may enable an automatic reset to the original pre-inflation higher flowrate capability upon a pressure of an isolation tool or a fluid communication passage, reduced below the setpoint pressure.

One embodiment provides a multi-stage reciprocating pump downhole tool for use within a borehole that extends into a subterranean formation. The tool comprises a controller module, power module, compensator module, linear actuation module, fluid control module, filter module and a connection joint for connecting to an isolation. The linear actuation module includes two pistons; a large surface area piston and a low surface area piston that is secured to a distal end of a linear actuation member and disposed within and isolating portions of a pressure chamber. A high-pressure side of the pressure chamber is disposed to draw fluid in and through the fluid control module when the rotary screw is rotated, and pump fluid out and through the fluid control module when the rotary screw is rotated in an opposite direction. The fluid control module is disposed to allow flow through to the pressure chamber by a first passageway from a filter module containing filtered fluid and out of the pressure chamber through a second passageway and through the filter module. Additionally, the fluid control module contains a hydraulic circuit to allow fluid through at a pressure provided by force applied to the combined surface areas of the large surface area piston and the small surface area piston, and when the setpoint pressure is exceeded, allows fluid through at a second setpoint pressure provided by force applied to the small surface area piston. The rotary screw receives mechanical power from a power module comprising an electrical motor which receives control signals from surface or from a control module which receives communication and control signals from surface.

In another embodiment, a bottom hole assembly (BHA) comprises the multi-stage reciprocating pump downhole tool, an isolation tool and a locating tool.

In a further embodiment, there is provided a method of isolating a portion of the borehole, the method comprising the steps of: deploying the BHA on wireline; utilizing the locating tool to locate a tubular segment within the borehole; positioning the BHA near or within the tubular segment such that the isolation tool is in a position to isolate the desired portions of the borehole upon pressurization; activating the multi-stage reciprocating pump downhole tool to provide fluid to the isolation tool; pressurizing the isolation tool to engage the borehole; isolating a portion of the borehole above the isolation tool from a portion of the borehole below the isolation; disconnecting the multi-stage reciprocating pump downhole tool from the isolation tool and removing the multi-stage reciprocating pump downhole tool from the borehole.

DETAILED DESCRIPTION

Figure 1:
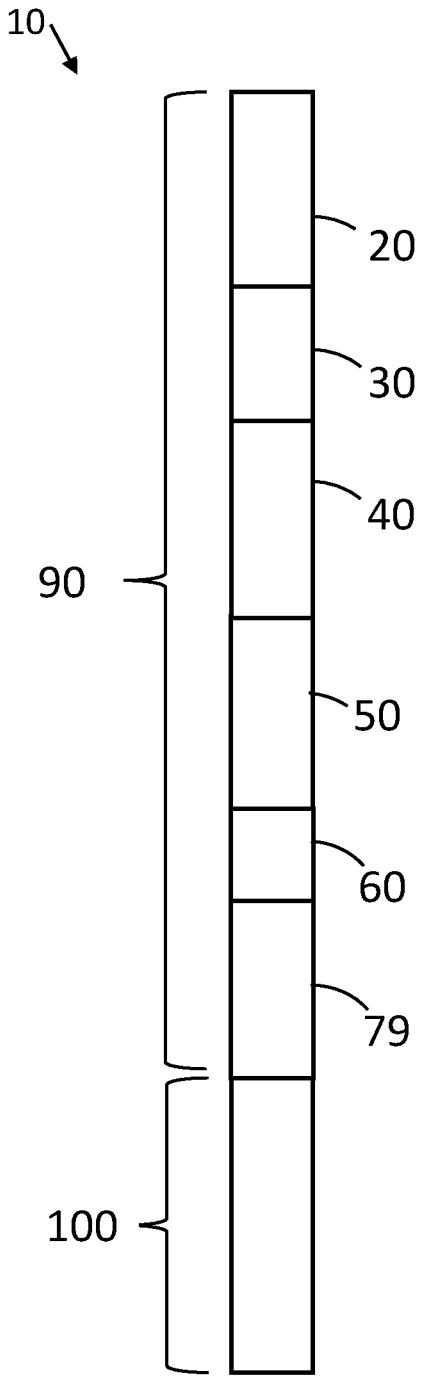
FIG. 1 is a block diagram of the modules of a multi-stage-stage reciprocating pump downhole tool.

A multi-stage reciprocating pump downhole tool is provided for use within a borehole that extends into a subterranean formation. The downhole tool comprises a controller module, power module, compensator module, linear actuation module, fluid control module, and a fluid source. The linear actuation module includes two pistons; a large surface area piston and a low surface area piston, secured to a distal end of an actuator and each disposed to translate within a low-pressure chamber and high-pressure chamber, respectively. The pressure chambers are disposed to draw fluid in from the fluid source and through the fluid control module when the actuator is translated in a first direction; and pump fluid out, through the fluid control module and out of the downhole tool via a flow-through tube within the fluid source enabling fluid communication from the pressure chambers, through the fluid source to the exterior of the tool when the actuator is translated in a second and opposite direction. The direction of translation of the actuator may be repeatedly alternated to cause the pistons to reciprocate axially within their respective chambers, to repeatedly draw in fluid from the fluid source and pump fluid out of the downhole tool.

In a preferred embodiment, the actuator is mechanical and comprises a rotary screw and threaded nut; extension member, return chamber, rotary screw housing, linear actuator housing and key sub. The piston body comprising the large area piston and the small area piston are disposed at a distal end of the extension member. The extension member is secured to the lower end of the threaded nut on the upper side of the key sub, comprises an anti-rotation keyway which is engaged with a protrusion or key on the key sub, and disposed through the key sub. The key sub is secured to the linear actuator housing on the lower end of the key sub and secured to a rotary screw housing on the upper end of the key sub. With rotation of the rotary screw, the threaded nut is translated along the central axis of the downhole tool; thereby, translating the extension member and piston body along the tool central axis. The large surface area piston and small surface area pistons are sliding sealed within their respective chambers to allow pressure to build inside the pressure chambers.

Where the actuator of the linear actuator module is mechanical, the rotary screw is mechanically coupled to an electrical motor in the power module to receive rotational mechanical power through the center of the compensator module; and converts the rotary motion to linear motion by means of the threads on the rotary screw and restricted rotary motion of the threaded nut by means of the secured and keyed extension piston. The direction of rotation of the rotary screw may be repeatedly alternated, thereby causing reciprocation of the extension member along the downhole tool central axis to cause the pressure chambers to repeatedly draw in fluid from the fluid source and pump out fluid, out of the downhole tool.

In another embodiment, the actuator of the linear actuator module is hydraulic and additionally comprises a hydraulic pump, valve control block, hydraulic pump housing, actuation chamber and retraction chamber. The piston body comprising the large surface area piston and the small surface area piston is disposed at a distal end of the extension member and each disposed to translate within a low-pressure chamber and high-pressure chamber, respectively. The hydraulic pump resides in a pump housing and provides pressurized hydraulic fluid to the valve control block. An actuation fluid passageway extends from the solenoid valve block to the actuation chamber on the uphole side of the extension member and a retraction fluid passageway extends from the valve block to the retraction chamber on the downhole side of the extension member. When the hydraulic pump pressurizes the retraction chamber by control of the valve block, the piston body is translated in the uphole direction and fluid is drawn into the pressure chambers form the fluid source and through the fluid control module. When the hydraulic pump pressurizes the actuation chamber by control of the solenoid valve block, the piston body is translated in the downhole direction, fluid is pumped out of the pressure chambers through the fluid control module and out of the downhole tool through the fluid source. Optionally, a compression spring may reside in the retraction chamber to push the extension piston in the uphole direction to create a suction to draw fluid into the pressure chambers.

Where the actuator of the linear actuator module is hydraulic, the hydraulic pump is in fluid communication with the compensator module and an electric motor in the power module is mechanically coupled to operate the hydraulic pump. A controller may control the operation of various solenoid valves of the solenoid valve block in order to direct hydraulic fluid to the actuation or retraction chamber.

The power module comprising the electrical motor may include a speed reducing gearbox and is disposed to receive power and communication signals from a control module. The electric motor preferably receives electrical power through a wireline cable but may receive some or all of its electrical power from a battery within the BHA.

Where the linear actuator is hydraulic, the compensator provides a hydraulic reservoir to supply the hydraulic pump with fluid which is pumped by the hydraulic pump to control the actuation and retraction of the piston body.

Where the linear actuator is mechanical, the compensator provides a hydraulic reservoir to supply the actuator with fluid as the actuator is actuated and displaces fluid which is pumped out of the multi-stage reciprocating pump downhole tool.

The multi-stage reciprocating pump downhole tool may further include a control module comprising a controller in electronic communication with the power module for receiving a current signal form the electrical motor and in electronic communication with electrical motor for sending a control signal to the electrical motor. The controller may, for example, control the operation of the electrical motor to maintain a desired rotational speed of the rotary screw the power module powers, thereby controlling the flowrate of the multi-stage reciprocating pump downhole tool. Additionally, the controller may, for example, control the operation of the electrical motor to maintain a desired torque of the rotary screw the power module powers, thereby controlling the pressure output of the multi-stage reciprocating pump downhole tool.

In an embodiment the valve control block is a solenoid valve control block comprising solenoid actuated valves.

In another embodiment, the controller may, for example, operate to control the operation of the electrical motor to maintain a desired speed of the hydraulic pump the power module powers, thereby controlling the flowrate of the multi-stage reciprocating pump downhole tool. Additionally, the controller may, for example, control the operation of the electrical motor to maintain a desired torque of the hydraulic pump the power module powers, thereby controlling the pressure of the multi-stage reciprocating pump downhole tool.

The controller may be an analog circuit or a digital processor, such as an application specific integrated circuit (ASIC) or array of field-programmable gate arrays (FPGAs). Accordingly, embodiments may implement any one or more aspects of control logic in the controller that is on-board the downhole tool or in a computing system that is in data communication with the controller. A computing system may be located at the surface to provide a user-interface for monitoring and controlling the operation of the downhole tool and may be in data communication with the controller over the wireline cable. The control module preferably receives electrical power through a wireline cable but may receive some or all of its electrical power from a battery within the BHA.

In an embodiment, the fluid source is an inner annular fluid volume of a filter module containing filtered fluid; the filter module comprising a ported housing, a filter cartridge, a flow through tube enabling fluid communication from the pressure chambers through the fluid control module to the exterior of the lower side of the bottom sub, an outer annular volume. and a bottom sub. The ported housing allows fluid communication with the borehole fluid residing exterior to the housing, such that fluid may flow from the borehole through the ported housing into the outer annular volume, through the filter and into the inner annular fluid volume.

In an embodiment, the fluid source is an inner fluid volume of a ported module; the ported module comprising a ported housing a bottom sub and a flow through tube enabling fluid communication from the pressure chambers through the fluid control module to the exterior of the lower side of the bottom sub.

In an embodiment, the fluid source is fluid inside of the borehole, exterior to the multi-stage reciprocating downhole tool.

In an embodiment, the fluid source is pump fluid contained in a reservoir module comprising; a reservoir outer housing, a reservoir inner body isolating reservoir fluid within the reservoir outer housing from well fluid allowed to communicate through one or more ports in the reservoir outer housing, and a flow through tube enabling fluid communication through the fluid control module from the pressure chambers to the exterior of the lower side of the bottom sub. As fluid is drawn into the pump chambers and pumped through the flow-through tube of the fluid reservoir, borehole pressure acts on the reservoir inner body through the one or more ports in the reservoir outer housing to provide a priming pressure to the pump chambers, via the hydraulic control module.

The fluid control module is disposed to allow fluid from the fluid source to flow through to the pressure chambers by a first passageway, from the fluid source when a suction is created in the high and low-pressure pump chambers by the translation of the piston body in the uphole direction, and allow flow from the pressure chambers through the fluid control module by a second passageway and through the fluid source via the flow-through tube by translation of the piston body in the downhole direction. Additionally, the fluid control module contains a hydraulic control circuit to control the flow of fluid through the fluid control module and through the fluid source from the pressure chambers at a pressure provided by force applied to the combined surface areas of the large surface area piston and the small surface area piston; and when the setpoint pressure is exceeded, allows fluid through the control module and through the fluid source at a pressure provided by force applied to the small surface area piston.

In an embodiment, the hydraulic control circuit comprises two output check valves which allow fluid to flow out of the high and low-pressure pump chambers and into the flow-through tube residing through the fluid source. The output check valves are checked in the opposing intake direction. The hydraulic control circuit additionally comprises two intake check valves which allow fluid to flow into the high and low-pressure pump chambers out of the fluid source. The intake check valves are checked in the opposing output direction.

A third check valve, a pilot operated check valve, is included on a passage from the fluid source to the low-pressure pump chamber. A fluid passage from the output side of the output check valve from the high-pressure pump chamber is routed to the pilot port of the pilot operated check valve. When pressure on the output side of the output check valve exceeds the setpoint pressure, the pilot pressure of the pilot operated check valve, flow from the low-pressure pump chamber flows through the pilot operated check valve and into the fluid source, leaving only the high-pressure pump chamber to build pressure when the piston body is translated in the downhole direction.

In another embodiment, the hydraulic control circuit additionally comprises a return chamber output check valve which allows fluid to flow out of the return chamber and into the flow-through tube residing in the fluid source and a return intake check valve which allows fluid to flow into the return chamber from the fluid source. The return chamber output check valve is checked in the opposing intake direction and the return intake check valve is checked in the opposite direction. Additionally, a return chamber pilot operated check valve, is provided on a passage connected to the return chamber. A fluid passage from the output side of the output check valve from the high-pressure pump chamber is routed to the pilot port of the return chamber pilot operated check valve. When pressure on the output side of the output check valve from the high-pressure pump chamber exceeds the setpoint pressure, the pilot pressure of the pilot operated check valve, flow from the return chamber flows through the pilot operated check valve and into the fluid source.

In an embodiment, a return chamber is provided on each of the pressure chamber opposing sides of both a high-pressure piston and a low-pressure piston; each return chamber disposed to intake fluid during translation of the pistons in a first direction and deliver fluid during translation of the pistons in an opposing second direction; the pressure chambers disposed to deliver fluid during translation of the pistons in the first direction and intake fluid during translation of the pistons in the second direction; the delivered fluid pressure limited up to a pilot pressure of a pilot-operated check valve disposed to sense the pressure on one or both sides of the high pressure piston.

In an embodiment, the multi-stage reciprocating pump downhole tool comprises two or more low pressure pistons, each fluidically isolating a return chamber and a pressure chamber.

In an embodiment, a return chamber is provided on each of the pressure chamber opposing sides of three or more pistons; one or more pistons, a high pressure piston; each return chamber disposed to intake fluid during translation of the pistons in a first direction and deliver fluid during translation of the pistons in an opposing second direction; the pressure chambers disposed to deliver fluid during translation of the pistons in the first direction and intake fluid during translation of the pistons in the second direction; the delivered fluid pressure limited up to a pilot pressure of a pilot-operated check valve disposed to sense the pressure on one or both sides of the high pressure piston.

In an embodiment, a return chamber is provided on each of the pressure chamber opposing sides of three or more pistons each of varying pressure face areas; each return chamber disposed to intake fluid during translation of the pistons in a first direction and deliver fluid during translation of the pistons in an opposing second direction; the pressure chambers disposed to deliver fluid during translation of the pistons in the first direction and intake fluid during translation of the pistons in the second direction; the delivered fluid pressure limited up to a first pressure, the pilot pressure of a piloted operated check valve disposed to sense the pressure on either a pressure or return chamber fluidically isolated by a piston comprising a progressively smaller pressure face area.

In an embodiment, the pilot pressure is equal to or greater than a pressure required to inflate an isolation tool.

In an embodiment, the pilot pressure is equal to a pressure greater than the pressure required to inflate an isolation tool and less than a pressure required to fully set an isolation tool.

In an embodiment the pilot pressure is equal to or greater than a pressure required by a downhole plug tool to expand to a borehole wall.

In an embodiment, a bottom hole assembly is comprised of the downhole tool and an isolation tool disposed to receive fluid from the lower end of the downhole tool.

The downhole tool may be connected to a wireline that extends from a wireline unit or truck located near an opening into the borehole. The wireline may be used to provide physical support of the downhole tool as it is raised and lowered into and within the borehole, supply electrical power to electronic components within the downhole tool, and/or provide for data communication between the downhole tool and control systems outside the borehole. While the wireline may be sufficient for raising and lowering the downhole tool within a substantially vertical borehole or portion of a borehole, a downhole tool on a wireline as a part of a BHA may further include a tractor that can push or pull the downhole tool along the borehole regardless of the orientation of the borehole, such as in a horizontal portion of a borehole.

In an embodiment, one or more pressure sensors may be in electronic communication with the controller and disposed to sense fluid pressure within the downhole tool. It should be recognized that the location of the pressure sensor within the downhole tool may vary, so long as the pressure sensor may sense the fluid pressure within one or both the high and low-pressure pump chambers or other chambers. For example, the pressure sensor may be located in the hydraulic control module or the key sub.

In an embodiment, a rotational sensor may be in electronic communication with the controller for sending a signal to the controller and disposed to detect the number of rotations of the rotary screw.

Statements made herein referring to a component, surface, face, opening or port being "above", "below", "uphole" or "downhole" relative to another component, opening or port should be interpreted as if the downhole tool or bottom hole assembly has been run into a borehole. It should be noted that even a horizontal borehole, or any non-vertical borehole, still has an "uphole" direction defined by the path of the borehole that leads to the surface and a "downhole" direction that is generally opposite to the "uphole" direction.

An embodiment provides a method of delivering fluid out of a reciprocating pump downhole tool, the method comprising: drawing in fluid from a fluid source through a fluid control module to a pressure chamber with a suction created in the chamber, by translation of a piston body in a first direction; and delivering the fluid from the pressure chamber, through the fluid control module, through the fluid source and out of the downhole tool via a flow-through tube within the fluid source, by translation of the piston body in an opposing second direction.

In an embodiment, the method further comprises, simultaneously drawing in fluid from the fluid source through the fluid control module to a second pressure chamber with a suction created in the second pressure chamber, by translation of a piston body in a first direction; and delivering the fluid from the second pressure chamber, through the fluid control module, through the fluid source and out of the downhole tool via the flow-through tube within the fluid source, by translation of the piston body in an opposing second direction. In an embodiment, the method further comprises delivering fluid from [[a]] the first pressure chamber up to a pressure limited by a pilot pressure of a pilot-operated check valve disposed to sense the output pressure from the second pressure chamber.

In an embodiment, the method further comprises delivering fluid from a return chamber fluidically isolated from the pressure chamber by the piston body, through the fluid control module, through the fluid source and out of the downhole tool via the flow-through tube within the fluid source, by translation of the piston body in the first direction; and drawing in fluid from the fluid source through the fluid control module to the return chamber with a suction created in the return chamber, by translation of the piston body in the opposing second direction.

In an embodiment, the method further comprises delivering fluid from a first pressure and return chamber up to a pressure limited by a pilot pressure of a pilot-operated check valve disposed to sense the output pressure from a second pressure chamber and an associated second return chamber.

In an embodiment, the method further comprises delivering fluid from a third or more pressure and return chambers up to a pressure limited by a pilot pressure of a pilot-operated check valve disposed to sense the output pressure from a first or more pressure chamber(s) and associated first or more return chamber(s).

In an embodiment, the method further comprises activating the actuator to selectively control the direction of translation of the piston body and repeatedly alternating the direction of translation of the piston body to draw in fluid from the fluid source and pump fluid out of the downhole tool.

In an embodiment, the method further comprises directing the fluid outflow of the first chamber to either flow through the fluid control module, through the fluid source and out of the downhole tool via the flow-through tube within the fluid source; or back into the fluid source, based on the pressure of the second pressure chamber.

Where the actuator is mechanical an embodiment provides a method of controlling fluid pressure within the pressure chambers. The method comprises monitoring parameters measured by a signal provided from the electrical motor to the control module and controlling operation of the rotary screw to prevent the monitored parameters from exceeding a setpoint value of one or more parameters.

Where the actuator is hydraulic, an embodiment provides a method of controlling fluid pressure within the pressure chambers. The method comprises monitoring parameters measured by a signal provided from the electrical motor to the control module and controlling operation of the hydraulic pump to prevent the monitored parameters from exceeding a setpoint value of one or more parameters.

In an embodiment, a bottom hole assembly (BHA) comprises the reciprocating pump downhole tool and an isolation tool connected to the downhole end of the fluid source disposed to receive pressurized fluid from the downhole tool.

In an embodiment, there is provided a method of isolating a portion of the borehole, the method comprising the steps of: deploying the BHA on wireline; positioning the BHA near or within a tubular segment such that the isolation tool is in a position to isolate the desired portions of the borehole upon pressurization; activating the downhole tool to provide fluid from the fluid source to the isolation tool to a predetermined pressure limit; the downhole tool automatically reducing its output flowrate and increasing its pressure output upon the isolation tool reaching the predetermined pressure limit and further pressurizing the isolation tool at the reduced flowrate and increased pressure to further engage the isolation tool to the borehole; isolating a portion of the borehole above the isolation tool from a portion of the borehole below the isolation tool; disconnecting the downhole tool from the isolation tool; the downhole tool automatically resetting to provide flow at a pressure below the predetermined pressure limit upon a reduction of pressure in the output passage below the predetermine pressure limit; and removing the downhole tool from the borehole.

In an embodiment, a bottom hole assembly (BHA) comprises a locating tool, the downhole tool and an isolation tool connected to the downhole end of the fluid source disposed to receive pressurized hydraulic fluid from the downhole tool.

In a further embodiment, there is provided a method of isolating a portion of the borehole, the method comprising the steps of: deploying the BHA on wireline; utilizing the locating tool to locate a tubular segment within the borehole; positioning the BHA near or within a desired tubular segment or region of a borehole such that the isolation tool is in a position to isolate the desired portions of the borehole upon pressurization; activating the downhole tool to provide fluid from the fluid source to the isolation tool to a predetermined pressure limit; the downhole tool automatically reducing its output flowrate and increasing its pressure output upon the isolation tool reaching the predetermined pressure limit; and further pressurizing the isolation tool at the reduced flowrate and increased pressure to further engage the isolation tool to the borehole; isolating a portion of the borehole above the isolation tool from a portion of the borehole below the isolation tool; disconnecting the downhole tool from the isolation tool; the downhole tool automatically resetting the hydraulic circuit to again provide flow at a pressure below the predetermined pressure limit; and removing the downhole tool from the borehole.

In an embodiment, the locating tool is a casing collar locator tool.

In an embodiment, the locating tool is a mechanical locating tool.

In an embodiment, the locating tool is a wireline tool.

In an embodiment, the locating tool is an electromagnetic induction tool.

In an embodiment, the locating tool is a gamma detection tool.

In an embodiment, the fluid source is a filter module.

In an embodiment, the fluid source is a fluid volume in the interior of a filter cartridge and in fluid communication with the borehole.

In an embodiment, the fluid source is a fluid volume filtered by filter and in fluid communication with the borehole.

In an embodiment, the fluid source is a fluid volume in the interior of a housing in fluid communication with the borehole.

In an embodiment, the fluid source is a reservoir module.

In and embodiment, the fluid source is a fluid volume in the interior of a reservoir module provided with fluid prior to deployment within a borehole.

In an embodiment of a method where the fluid source is a reservoir module, the method further comprises supplying the reservoir module with inflation fluid prior to the deployment step.

FIG. 1 is a diagram of a bottom hole assembly (BHA) 10 comprising a multi-stage reciprocating pump downhole tool (downhole tool) 90 disposed to pressurize an isolation tool 100. The [[two]] multi-stage reciprocating pump downhole tool comprises a controller module 20 disposed to send and receive signals from other modules of the tool 90 including signals to and from a power module 30 located below the control module 20. The power module 30 converts electrical power into mechanical power and transmits the mechanical power through a below mounted compensator module 40 to a linear actuation module 50 mounted below the compensator module 40. Fluid flow from the linear actuation module 50 is controlled by a fluid control module 60, which receives fluid from a below mounted fluid source 79 and delivers the fluid through the fluid source 79 to the isolation tool 100.

Figures 2A, 2B, 2C:
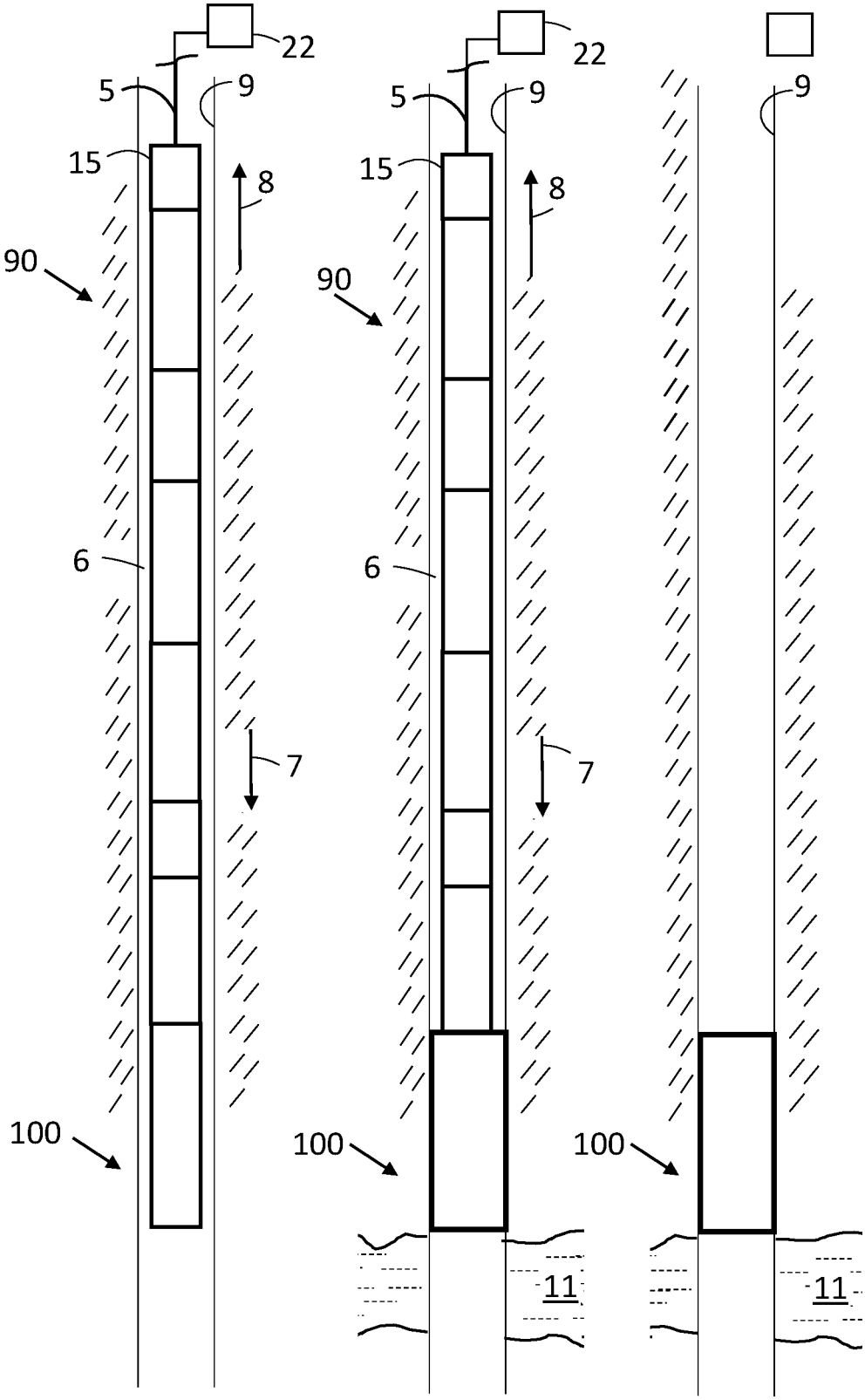
FIGS. 2A-C are diagrams of a bottom hole assembly, the bottom hole assembly including a multi-stage reciprocating pump down hole tool and an isolation tool being run into a borehole on a wireline, the isolation tool in the borehole set to isolate a borehole region above the isolation tool from a portion of borehole below the isolation tool and the isolation tool left in the borehole.

In FIG. 2A, the BHA 10 is disposed in a borehole 6 with the wireline cable 5 coupled to the tool 90 via a cable head 15. The cable is coupled to a truck or unit (not shown) at the surface above the borehole 6. The wireline cable 5 may provide physical support to the downhole tool 90, supply electrical power to the downhole tool, and enable data communication between the downhole tool and a computing system 22 at the surface above the borehole. The arrow 8 illustrates an uphole direction and the arrow 7 illustrates a downhole direction defined by the borehole pathway to the surface.

In FIG. 2B, the BHA 10 has been run into the borehole 6 to a location where the isolation tool 100 is above target subterranean formation 11. In this location, the isolation tool 100 is pressurized to seal against the wall of the borehole, 9, where the wall is typically an inside surface of a metal casing string. With the isolation tool 100 sealed within the borehole 6, the region of the borehole above or uphole of the isolation tool 100 is fluidically isolated from the region of the borehole below or downhole of the isolation 100.

In FIG. 2C, the downhole tool 90 has been disconnected from the isolation tool 100, the isolation tool 100 left in the borehole 6 and the downhole tool 90 removed from the borehole 6.

Figure 3A:
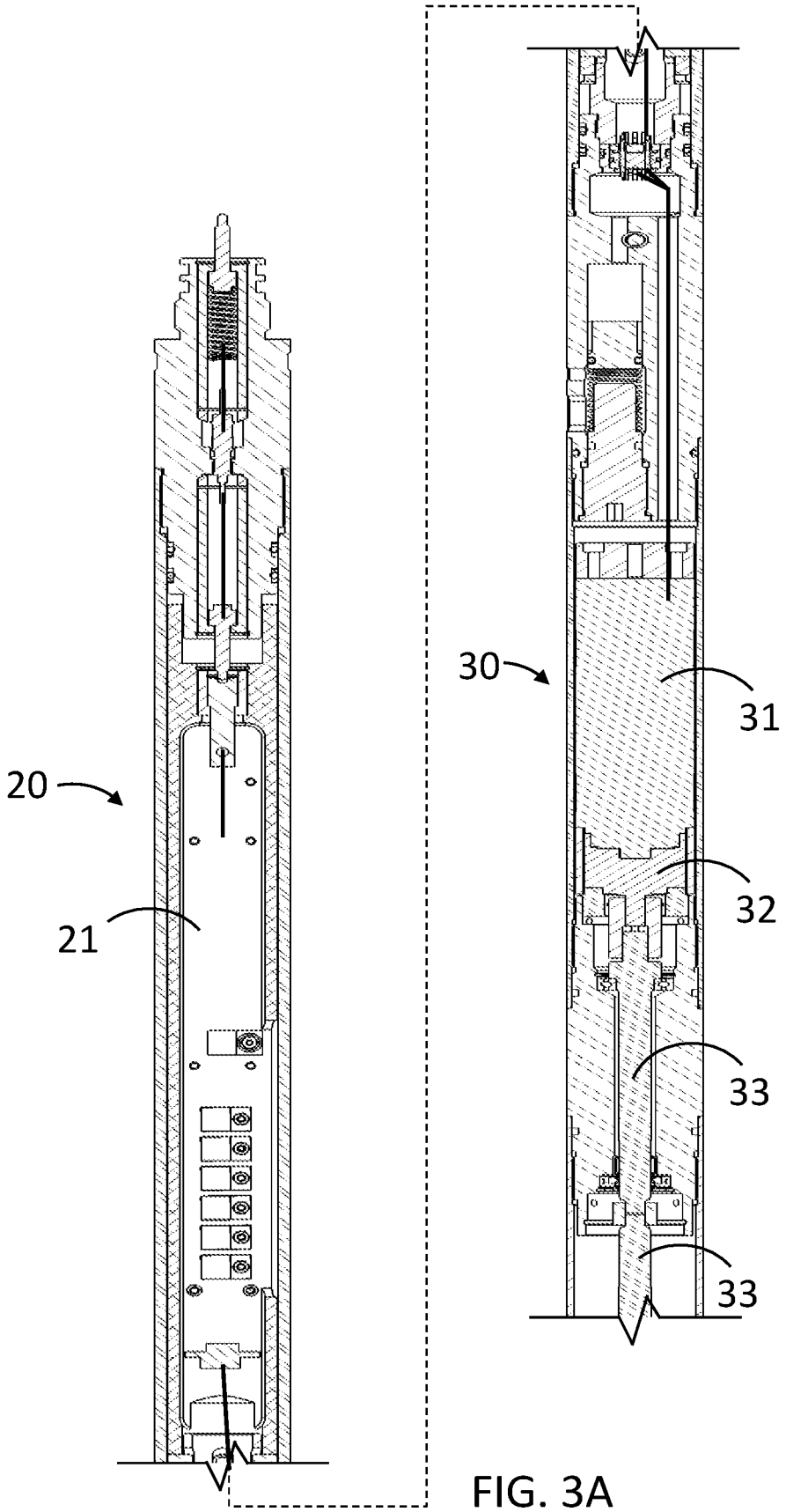
FIGS. 3A, 3B and 3C are cross-sectional partial views of a multi-stage reciprocating pump downhole tool along line 3-3 of FIG. 5.
Figure 3B:
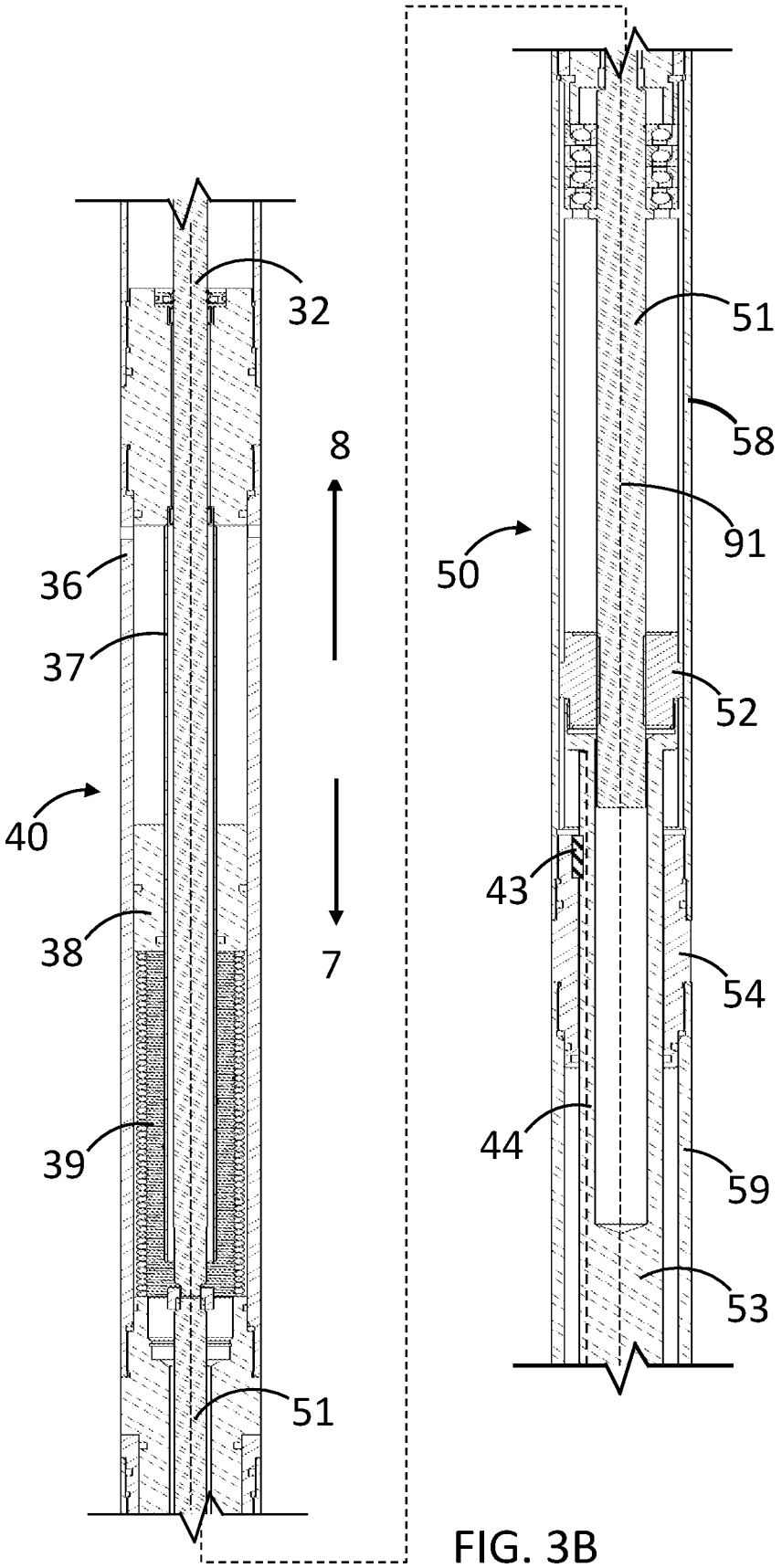
Figure 5:
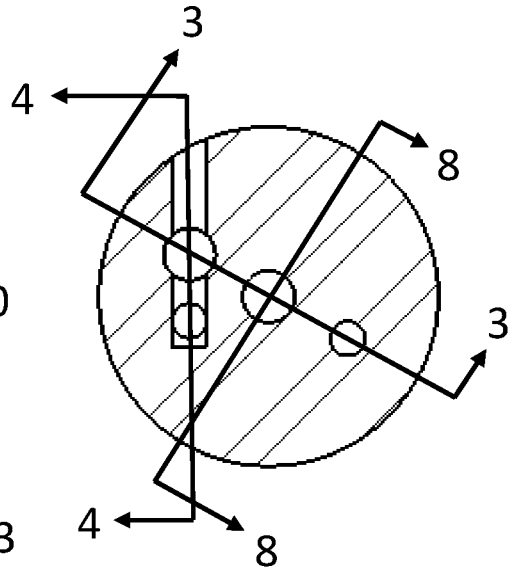
FIG. 5 is a cross-sectional view of a multi-stage reciprocating pump downhole tool along line 5-5 of FIG. 4.

FIG. 3A-3B are cross-sectional partial views of a multi-stage reciprocating pump downhole tool 90 along line 3-3 of FIG. 5 with a filter module 80 as the fluid source. The downhole tool 90 has a cable head 15 at its proximal (uphole) end for securing the wireline cable 5 (see also FIGS. 2A-2C). The wireline cable 5 may include a physical support line, an electrical power supply line, and a data communication line. The physical support line, such as a braided metal cable, may terminate at the cable head 15, but the electrical power supply line and data communication line extend through the cable head 15 to a control module 20 which is comprised of a controller 21 in electronic communication with a power module 30 mounted below the controller module 20. The power module comprises an electrical motor 31 and a speed reducing gearbox 32. The controller module 20 is disposed to receive a current signal form the electrical motor 31 and to send a control signal to the electrical motor 31. The electrical motor 31 is disposed to transmit mechanical power to the speed reducing gearbox 32. The speed reducing gearbox 32 is disposed to transmit rotational mechanical power to the transmission shaft 33, which extends out of the power module 30, into and through the compensator module 40. A rotary screw 51 of the linear actuator module 50 mounted below the compensator module 40, is disposed to receive rotational mechanical power from the transmission shaft 33. The rotary screw 51 is housed in the rotary screw housing 58. A threaded nut 52 is threaded onto the rotary screw 51 and is secured to an extension member 53. The extension member 53 extends through a key sub 54 and into piston housing 59. Additionally, the extension piston 53 comprises a keyway 44, which is engaged with a protruding feature or key 43 of the key sub 54, to prevent rotary motion of the extension piston 53 about the downhole tool central axis 91 when the rotary screw 51 is rotated. Preventing rotation of the extension piston 53, also prevents the rotation of the threaded nut 52 from rotating about the downhole tool central axis 91. This causes the extension piston 53 and nut 52 to travel axially along the central axis 91 of the downhole tool 90 when the rotary screw 51 is rotated. A piston body 42, comprising a low-pressure piston 48 with a large surface area and a high-pressure piston 47 with a small surface area is secured to a distal lower end of the extension member 53 and a sliding seal 49 is disposed on the outer surface of the low pressure piston 48, isolating two chambers; a low-pressure chamber 55 and a return chamber 57. The high-pressure piston 47 extends into and is sealed with high pressure sliding seal 46 within high-pressure chamber 56 of the hydraulic control module 60, which is secured to the lower end of the piston housing 59. A filter module 80 is secured to the lower end of the hydraulic control module 60. The filter module 80 comprises a ported housing 81, to allow borehole fluid to flow through, enter an annular fluid volume 82, and flow through a filter cartridge 83 to an inner annular volume 84. A bottom sub 86 is secured to the lower end of the ported housing 81 and a flow through tube 85 extends from the hydraulic control module 60, to and through the bottom sub 86. The hydraulic control module 60 (see also FIGS. 5, 6, 7, and 9) comprises two output check valves, 62 and 64 which allow fluid to flow out of the low and high-pressure pump chambers 55 and 56, respectively, via output hydraulic passages 63 and 65, respectively, into the flow-through tube 85 of the filter module 80 and through the bottom sub 86. The output check valves 62 and 64 are checked in the opposing intake direction. The hydraulic control module 60 additionally comprises two intake check valves 66 and 68 which allow fluid to flow into the high and low-pressure pump chambers 56 and 55, respectively, via intake hydraulic passages 67 and 69, respectively, from the inner annular fluid volume 84 in the interior of the filter cartridge 83. The intake check valves are checked in the opposing output direction. When the piston body 42 is translated in the uphole direction 8 by rotation of the rotary screw 51, a suction is created in low and high-pressure chambers 55 and 56, and fluid is drawn from the borehole 6, through the filter module 80, through intake check valves 66 and 68 and into low and high-pressure chambers 55 and 56. When rotation of the rotary screw 51 is reversed, the borehole fluid accumulated in the low and high-pressure chambers 55 and 56 is pressurized and flows out of the low and high-pressure chambers 55 and 56, through output hydraulic passages 63 and 65, through output check valves 62 and 64, into flow through tube 85 and through bottom sub 86. The hydraulic control module 60 additionally comprises a third check valve, a pilot operated check valve 70 and is provided on a pilot operated check valve passage 71 routed from the inner annular fluid volume 84 in the interior of the filter cartridge 83 to the low-pressure pump chamber 55. A pilot fluid passage 72 from the output side, of the output check valve 64 is routed to the pilot port 73 of the pilot operated check valve 70. When fluid is accumulated in the high-pressure chamber 56, and is pressurized by the downhole direction 7 movement of the piston body 42, such that pressure is communicated through output hydraulic passage 65 and through output check valve 64, that exceeds a pilot pressure of the pilot operated check valve 70, flow from the low-pressure pump chamber 55 flows through the pilot operated check valve 70 via pilot operated check valve passage 71 and into the inner annular fluid volume 84 on the interior of the filter cartridge 83.

With reference to FIG. 3B, the compensator module 40 comprises a compensator piston 38 spring loaded by spring 39 and disposed to translate within compensator housing 36 and on compensator mandrel 37. A volume on the uphole side of the compensator piston 38 is in fluid communication with the tool exterior; for example, the borehole 6 and a hydraulic fluid volume on the downhole side of the compensator piston 38 is in fluid communication with the linear actuator module 50.

Figure 4:
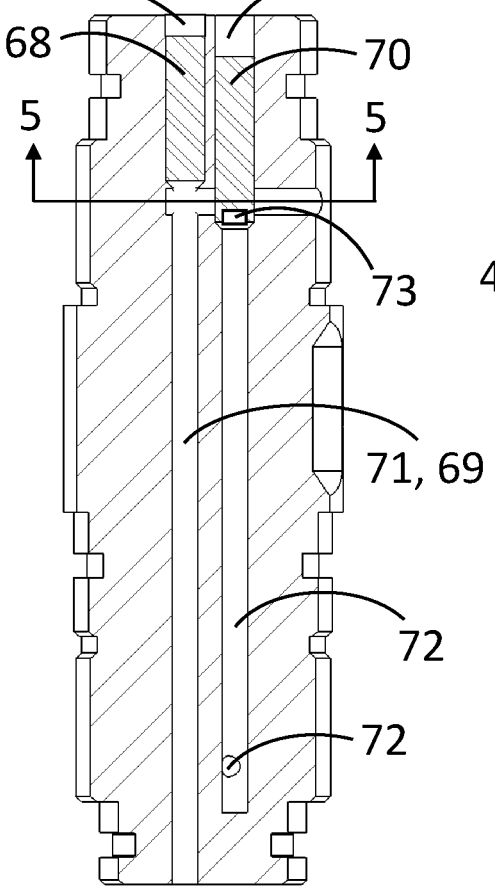
FIG. 4 is a cross-sectional view of a hydraulic control module along line 4-4 of FIG. 5.

FIG. 4 is a cross-sectional view of a hydraulic control module along line 4-4 of FIG. 5. Intake check valve 68 can be seen which is routed to the low-pressure chamber 55 from the fluid source 79. Also visible in this cross-section is pilot-operated check valve 70, the pilot passage 72 and the pilot operated check valve passage 71.

FIG. 5 is a cross-sectional view of the multi-stage reciprocating pump downhole tool along line 5-5 of FIG. 4.

Figure 6:
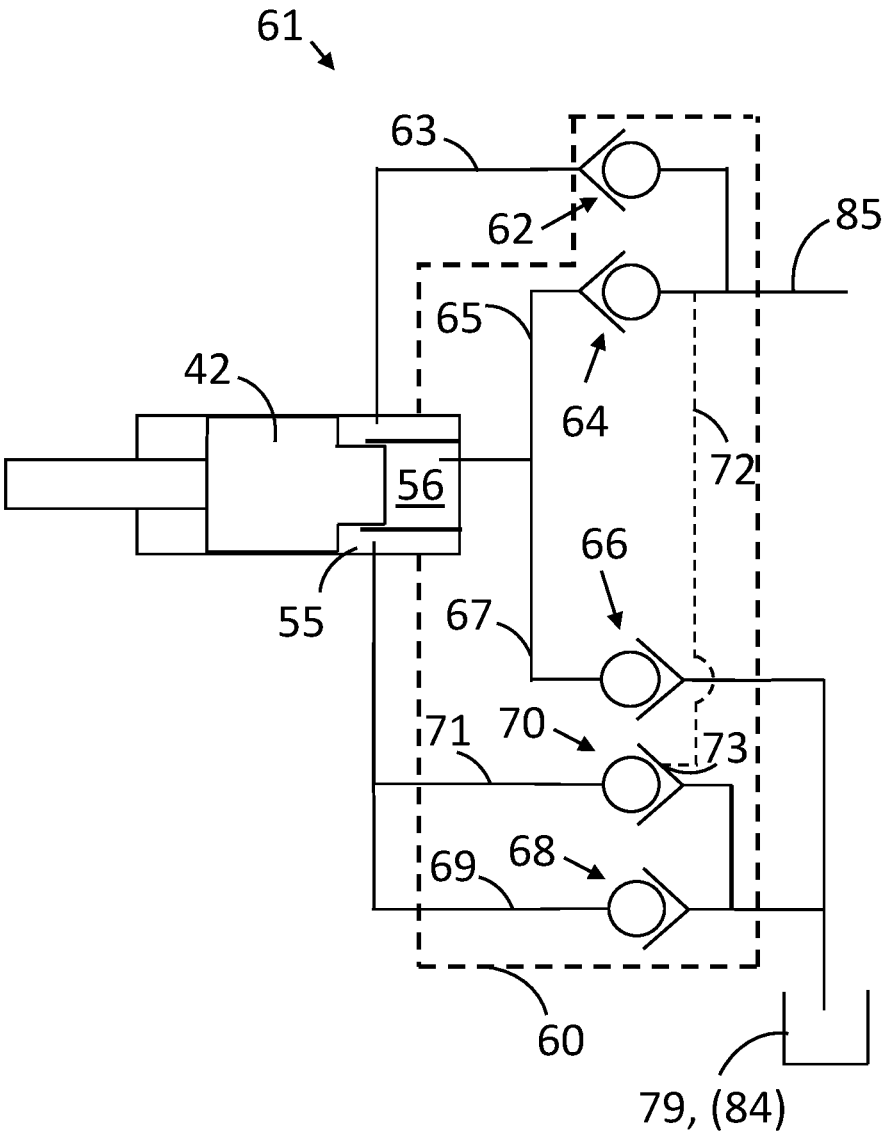
FIG. 6 is a hydraulic control schematic of a multi-stage reciprocating pump downhole tool.

FIG. 6 is hydraulic schematic of the hydraulic circuit comprised within the hydraulic control module 60. The circuit comprises two output check valves, 62 and 64 which allow fluid to flow out of the low and high-pressure pump chambers 55 and 56, respectively, and into the flow-through tube 85 of the filter module 80. The output check valves are checked in the opposing intake direction. The hydraulic control circuit 61 additionally comprises two intake check valves 66 and 68 which allow fluid to flow into the high and low-pressure pump chambers 56 and 55, respectively, out of the inner annular fluid volume 84 in the interior of the filter cartridge 83. The intake check valves are checked in the opposing output direction. A third check valve, a pilot operated check valve 70 is provided on a passage 71 from the inner annular fluid volume 84 in the interior of the filter cartridge 83 to the low-pressure pump chamber 55. A pilot fluid passage 72 from the flow-through tube 85 side, the output side, of the output check valve 64 is routed to the pilot port 73 of the pilot operated check valve 70. When pressure on the output side of the output check valve 64 exceeds a pilot pressure of the pilot operated check valve 70, flow from the low-pressure pump chamber 55 flows through the pilot operated check valve 70 and into the inner annular fluid volume 84 on the interior of the filter cartridge 83 via passage 71.

Figure 3C:
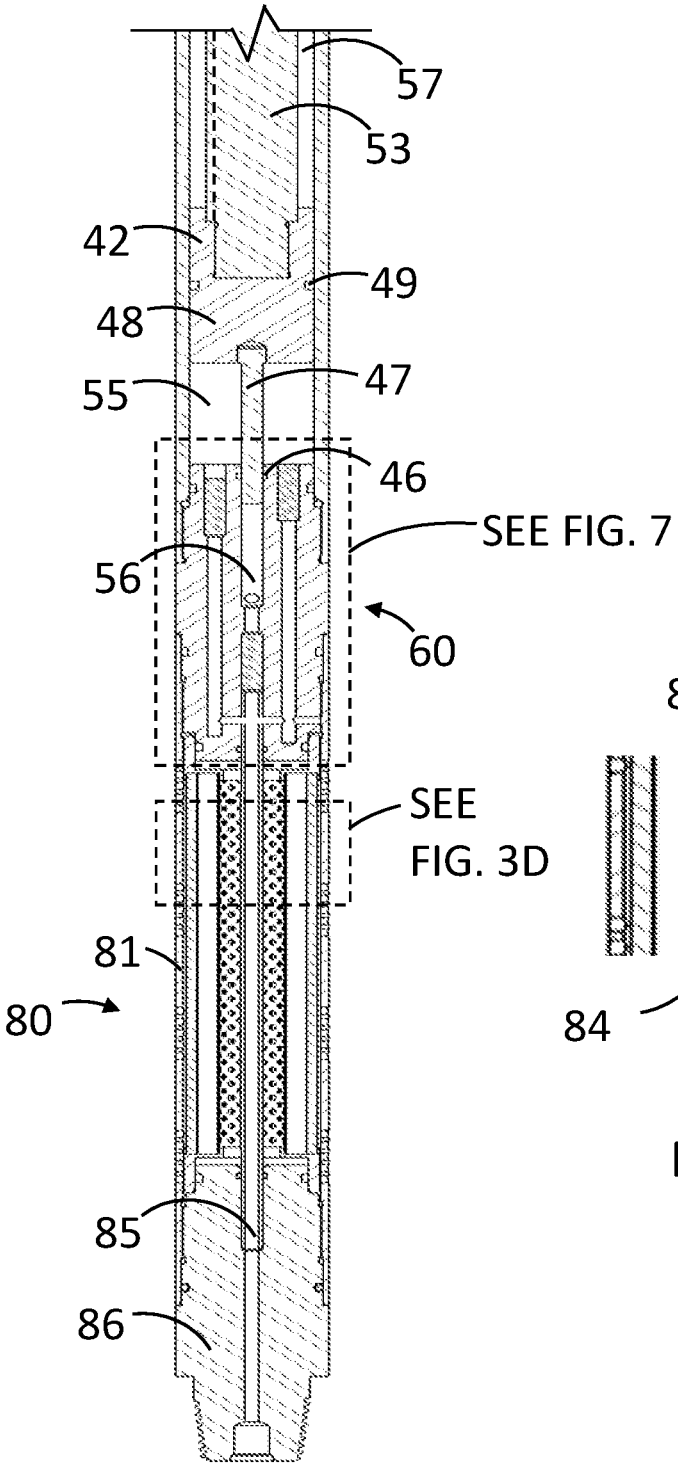
Figure 3D:
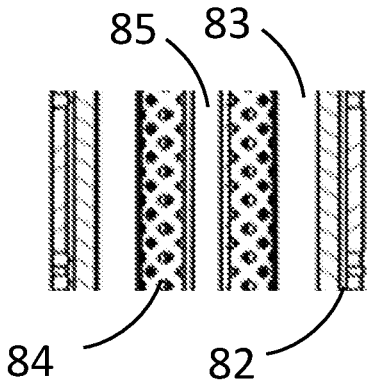
FIG. 3D is a close-up view of a section of the filter module section view of FIG. 3C.
Figure 7:
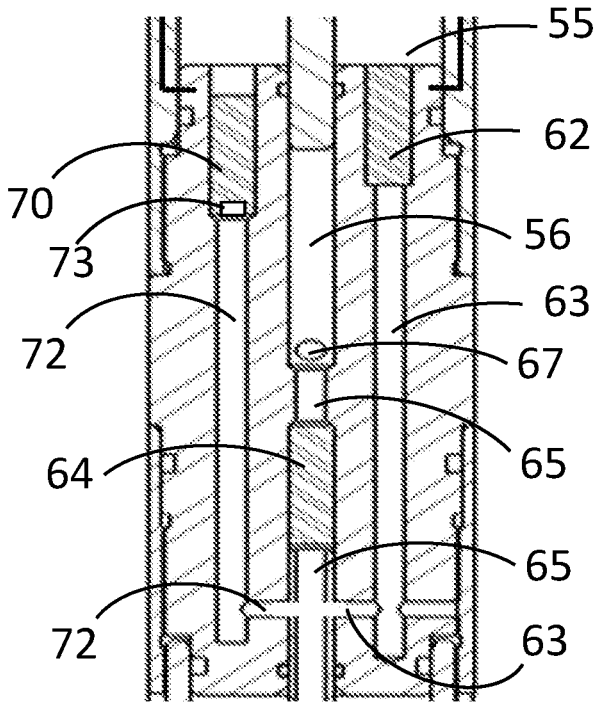
FIG. 7 is a close-up view of the hydraulic control module section view of FIG. 3C.

FIG. 7 is a close-up view of the hydraulic control module view shown in FIG. 3C. Output check valve 62 can be seen which allows flow from the low-pressure chamber 55 through the output passage 63, to output passage 65. Also visible in this cross-section is pilot-operated check valve 70, the pilot passage 72, the output check valve 64 which allows flow from the high-pressure chamber 56 to the output passage 65.

Figure 8A:
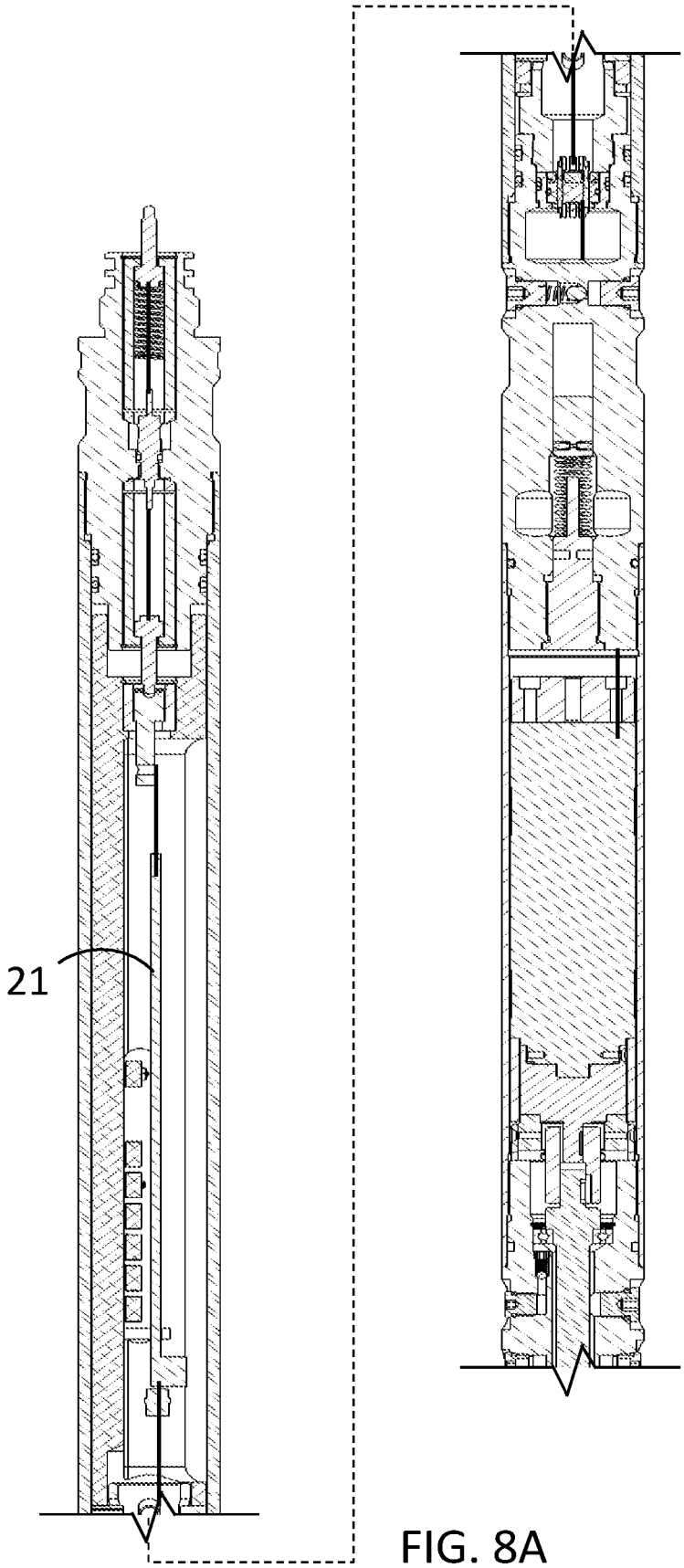
FIGS. 8A, 8B and 8C are cross-sectional partial views of a multi-stage reciprocating pump downhole tool along line 8-8 of FIG. 5.
Figure 8B:
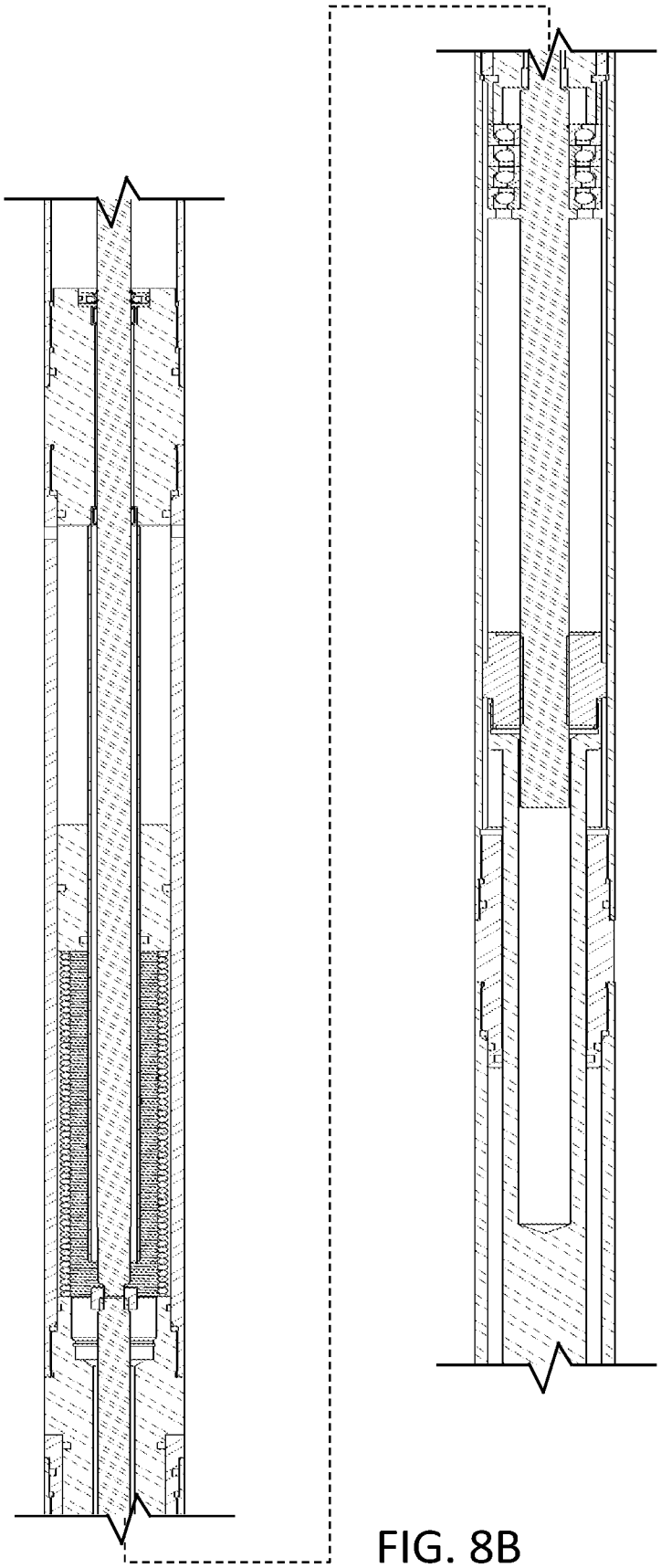
Figure 8C:
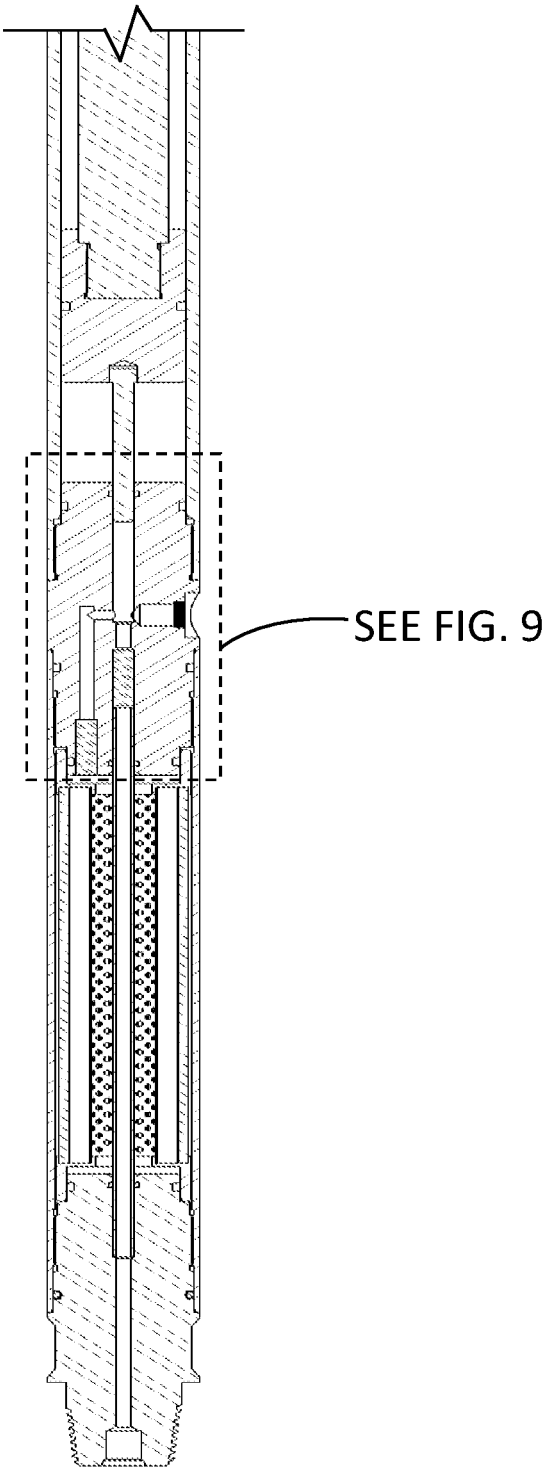

FIGS. 8A-8C are cross-sectional partial views of the multi-stage reciprocating pump downhole tool along line 8-8 of FIG. 5.

Figure 9:
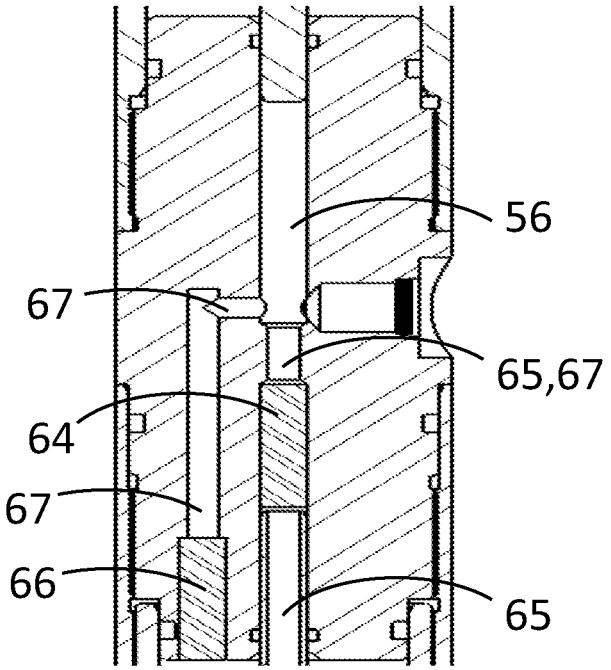
FIG. 9 is a close-up view of the hydraulic control module section view of FIG. 8C.

FIG. 9 is a close-up view of the hydraulic control module view shown in FIG. 8C. Output check valve 64 can be seen which allows flow from the high-pressure chamber 56 through the output passage 65. Also visible in this cross-section is intake check valve 66, which allows flow to the high-pressure chamber 56 from the output of fluid source 84.

Figure 10:
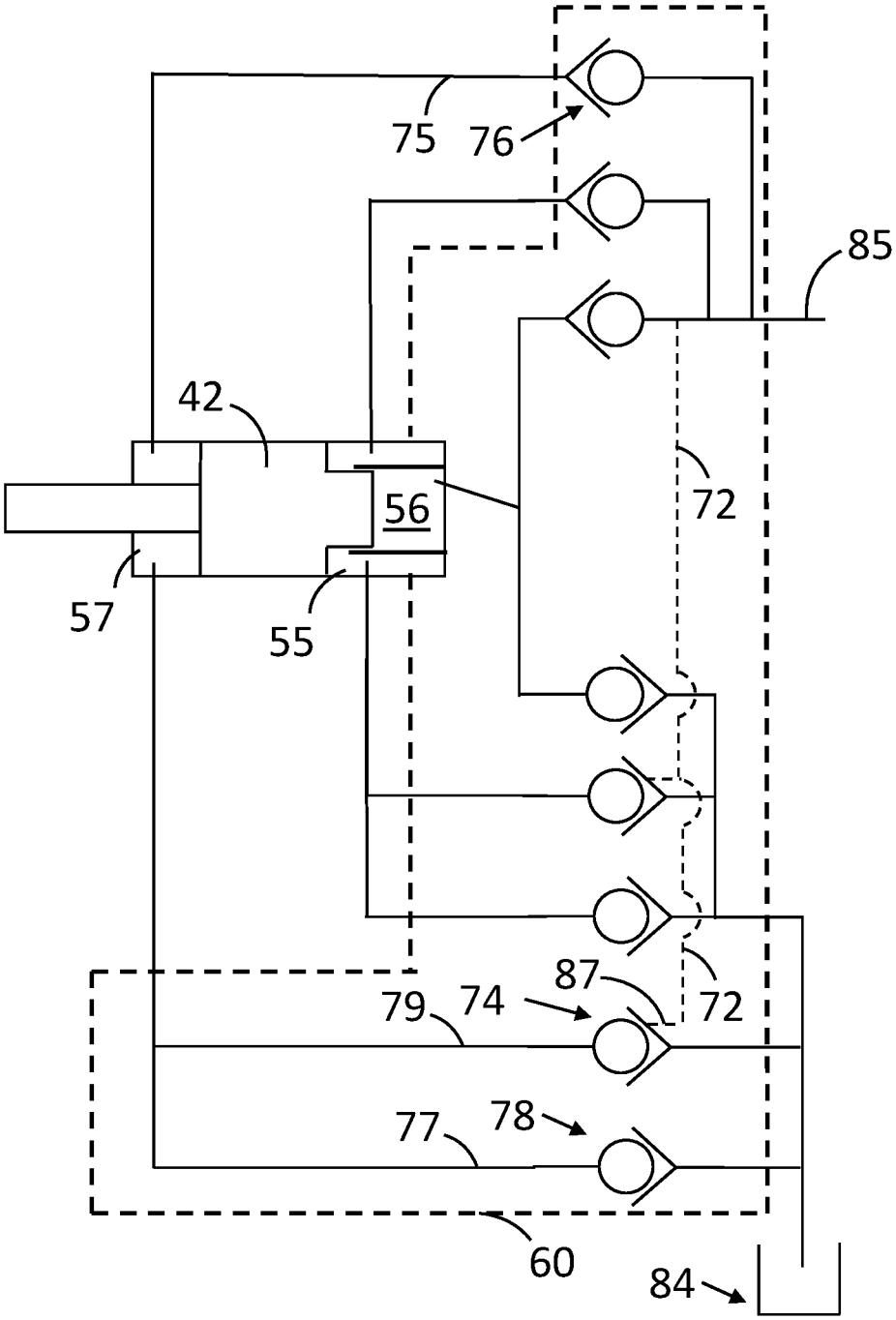
FIG. 10 is a hydraulic control schematic of another embodiment of a multi-stage reciprocating pump downhole tool.

FIG. 10 is a hydraulic control schematic of an embodiment of a multi-stage reciprocating pump downhole tool; the hydraulic control schematic of FIG. 6, additionally comprising a return chamber disposed to intake fluid when a suction is created in the chamber 57 and output fluid to the flow-through tube 85 and through bottom sub 86 when fluid is pressurized in the chamber 57.

Figure 11A:
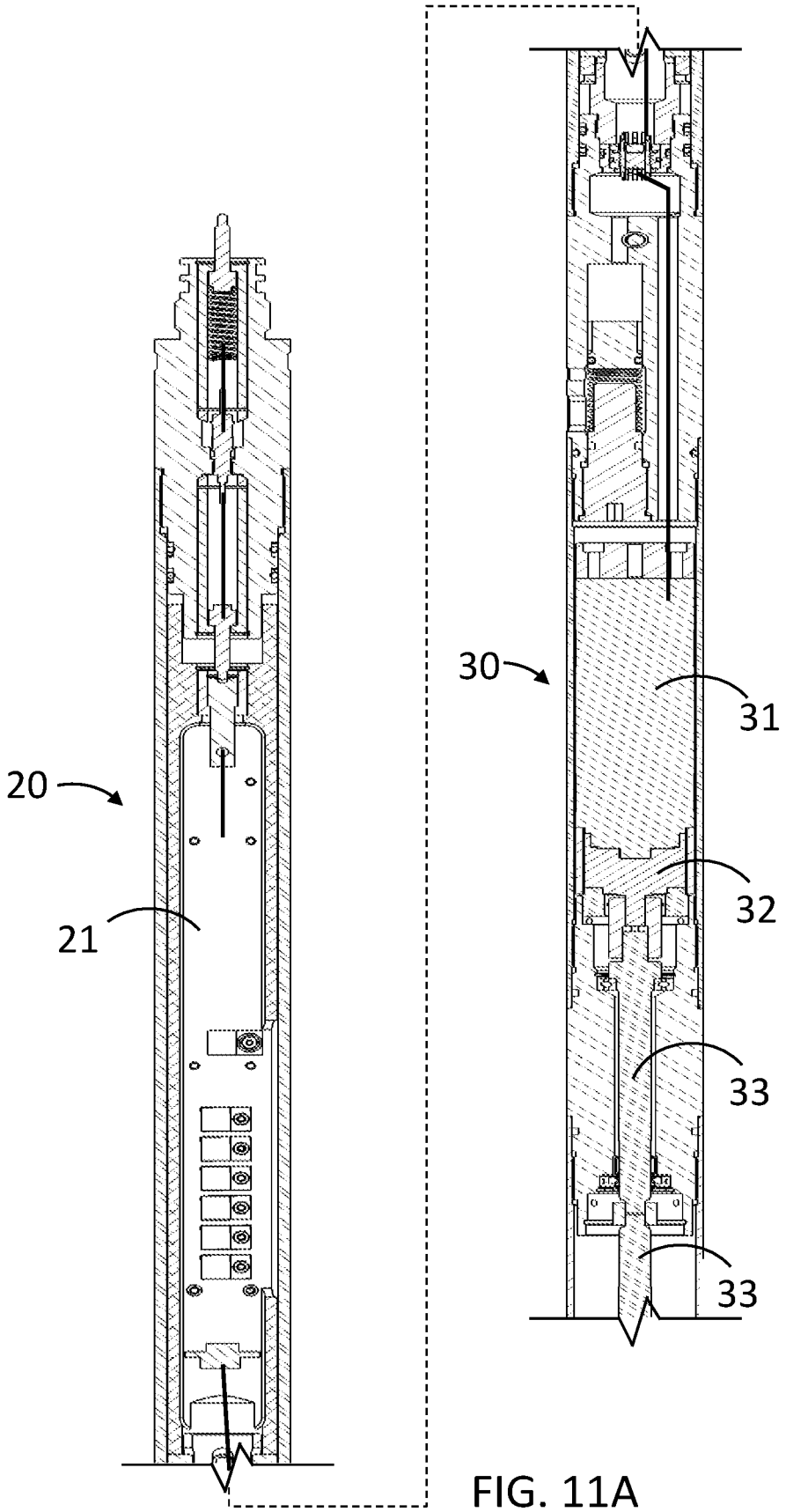
FIGS. 11A, 11B and 11C are cross-sectional partial views of another embodiment of a multi-stage reciprocating pump downhole tool.
Figure 11B:
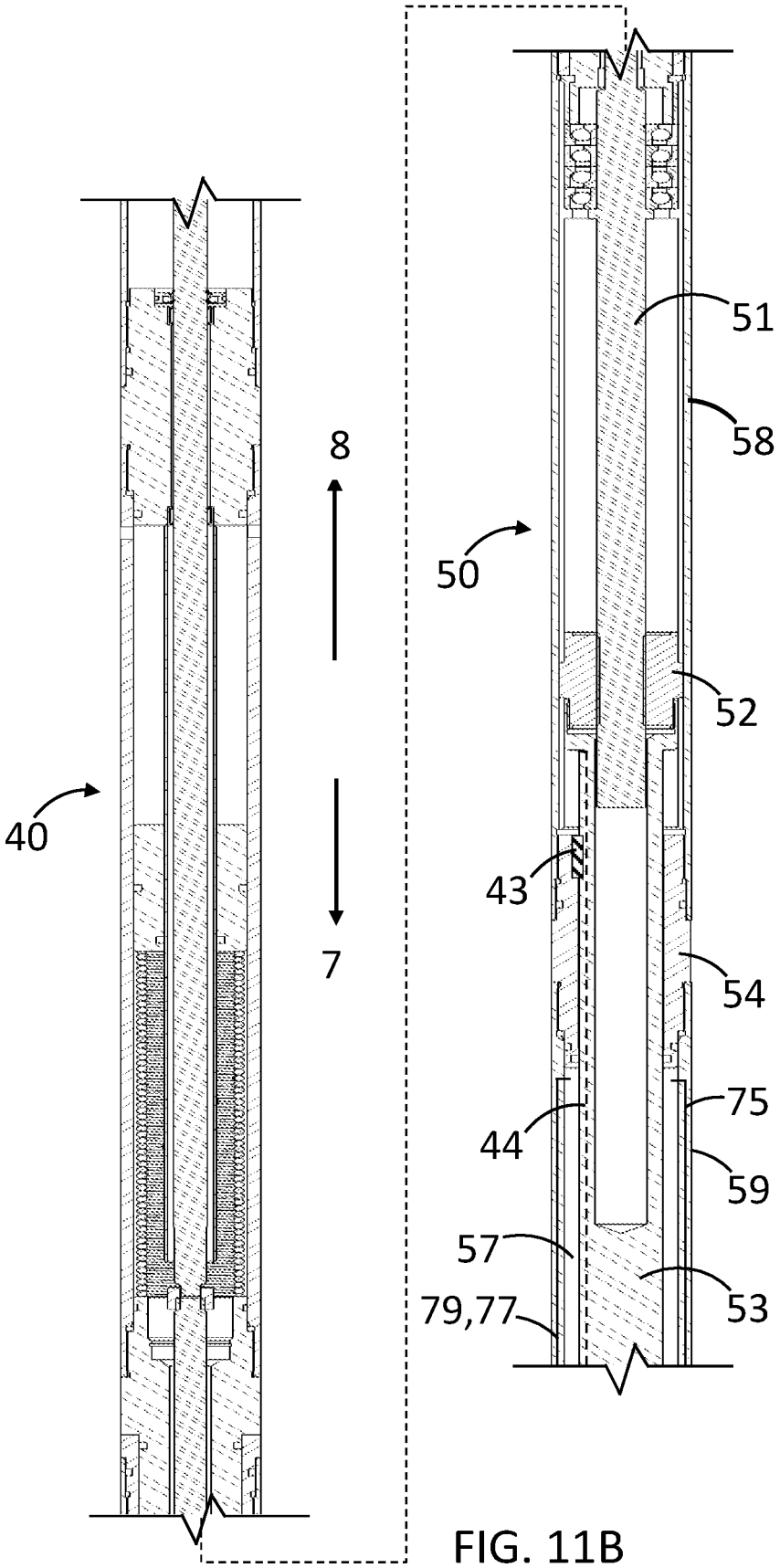
Figure 11C:
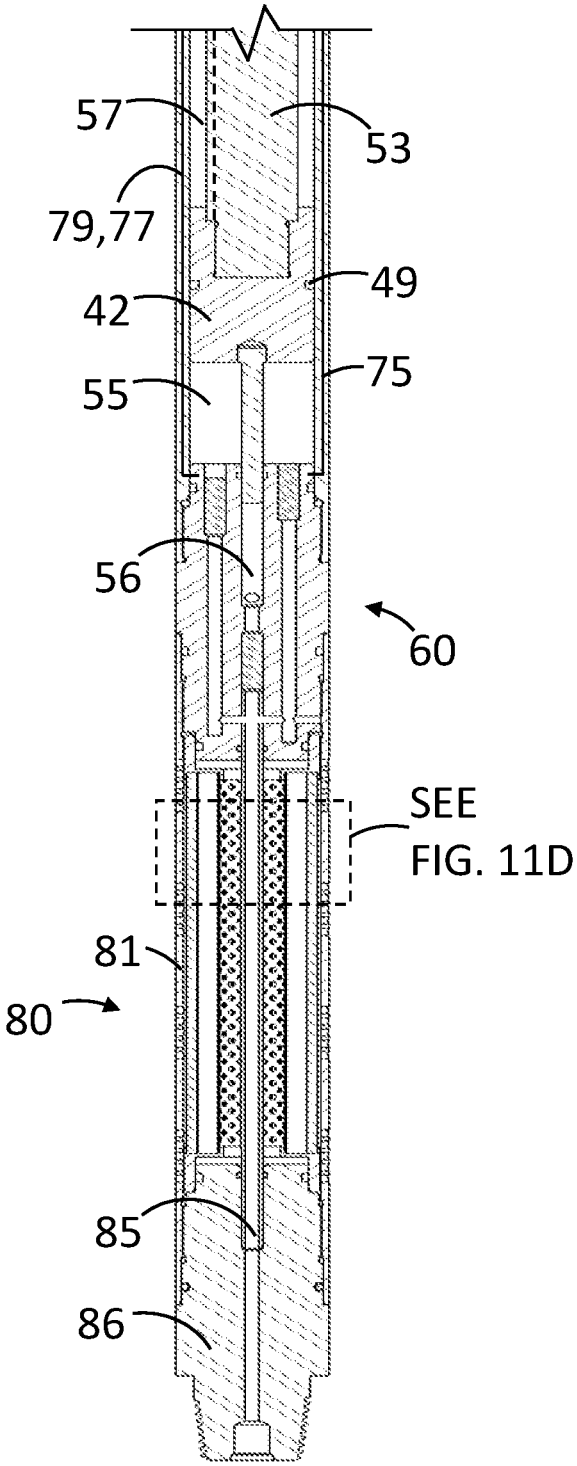
Figure 11D:
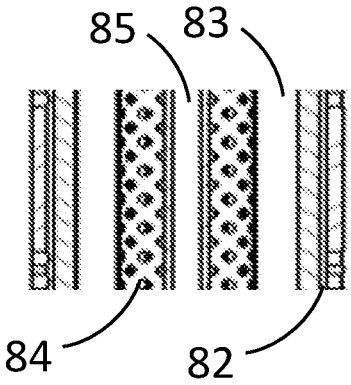
FIG. 11D is a close-up view of a section of the filter module section view of FIG. 11C.

FIGS. 11A-11C are cross-sectional partial views of another embodiment of a multi-stage reciprocating pump downhole tool. In this embodiment the hydraulic control module 60 (see also FIG. 10 with Ref. to FIG. 6) additionally comprises a return chamber output check valve 76, a return chamber intake check valve 78 and a return chamber pilot operated check valve 74. The return chamber output check valve 76 on return chamber output passage 75 allows fluid to flow out of the return chamber 57 through the hydraulic control module 60 and into the flow-through tube 85 of the filter module 80 via return chamber output passage 75. The return chamber output passage 75 is routed from the return chamber 57 into the wall of extension piston housing 59 and into the hydraulic control module 60 to the flow-through tube 85. The return chamber intake check valve 78 on return chamber intake passage 77 allows fluid to flow into the return chamber 57 through the hydraulic control module 60 from the inner annular fluid volume 84 of the filter module 80. The return chamber intake passage 77 is routed from the inner annular fluid volume 84, into the hydraulic control module 60, into the wall of extension piston housing 59 and into the return chamber 57. The return chamber pilot operated check valve 74, is provided on a passage 79 from the inner annular fluid volume 84 in the interior of the filter cartridge 83 to return chamber 57. The pilot fluid passage 72 from the output side, of the output check valve 64 is routed to the pilot port 87 of the pilot operated check valve 74. When pressure on the output side of the output check valve 64 exceeds a pilot pressure of the pilot operated check valve 74, flow from the return chamber 57 flows through the pilot operated check valve 74 via passage 79 and into the inner annular fluid volume 84 on the interior of the filter cartridge 83.

When the piston body 42 is translated in the uphole direction 8 by rotation of the rotary screw 51, a suction is created in low and high-pressure chambers 55 and 56, fluid is drawn from the borehole 6 (also see FIG. 2), through the filter module 80, through intake check valves 66 and 68, into low and high-pressure chambers 55 and 56; and fluid is pressurized in the return chamber 57, flows out of the return chamber 57, through output hydraulic passage 75, through return chamber output check valve 76, into flow-through tube 85 and through bottom sub 86. When rotation of the rotary screw 51 is reversed, the well fluid accumulated in the piston low and high-pressure chambers 55 and 56 is pressurized, flows out of the low and high-pressure chambers 55 and 56, through output hydraulic passages 63 and 65, through output check valves 62 and 64, into flow through tube 85, through bottom sub 86; and a suction is created in return chamber 57, fluid is drawn from the borehole 6, through the filter module 80, through return chamber intake check valve 78 and into return chamber 57. When pressure on the output side of the output check valve 64 exceeds a pilot pressure of the pilot operated check valve 74, flow from the return chamber 57 flows through the pilot operated check valve 74 via passage 79 and into the inner annular fluid volume 84 on the interior of the filter cartridge 83 during an uphole translation of the piston body 42.

In an embodiment, the pilot pressure of pilot operated check valve 74 is equal to the pilot pressure of pilot operated check valve 70.

In an embodiment, the pilot pressure of pilot operated check valve 74 differs from the pilot pressure of pilot operated check valve 70.

In an embodiment, the pilot pressure is equal to or greater than a pressure required by an isolation tool to inflate.

In an embodiment the pilot pressure is equal to or greater than a pressure required by a downhole plug tool to expand to a borehole wall.

Figure 12A:
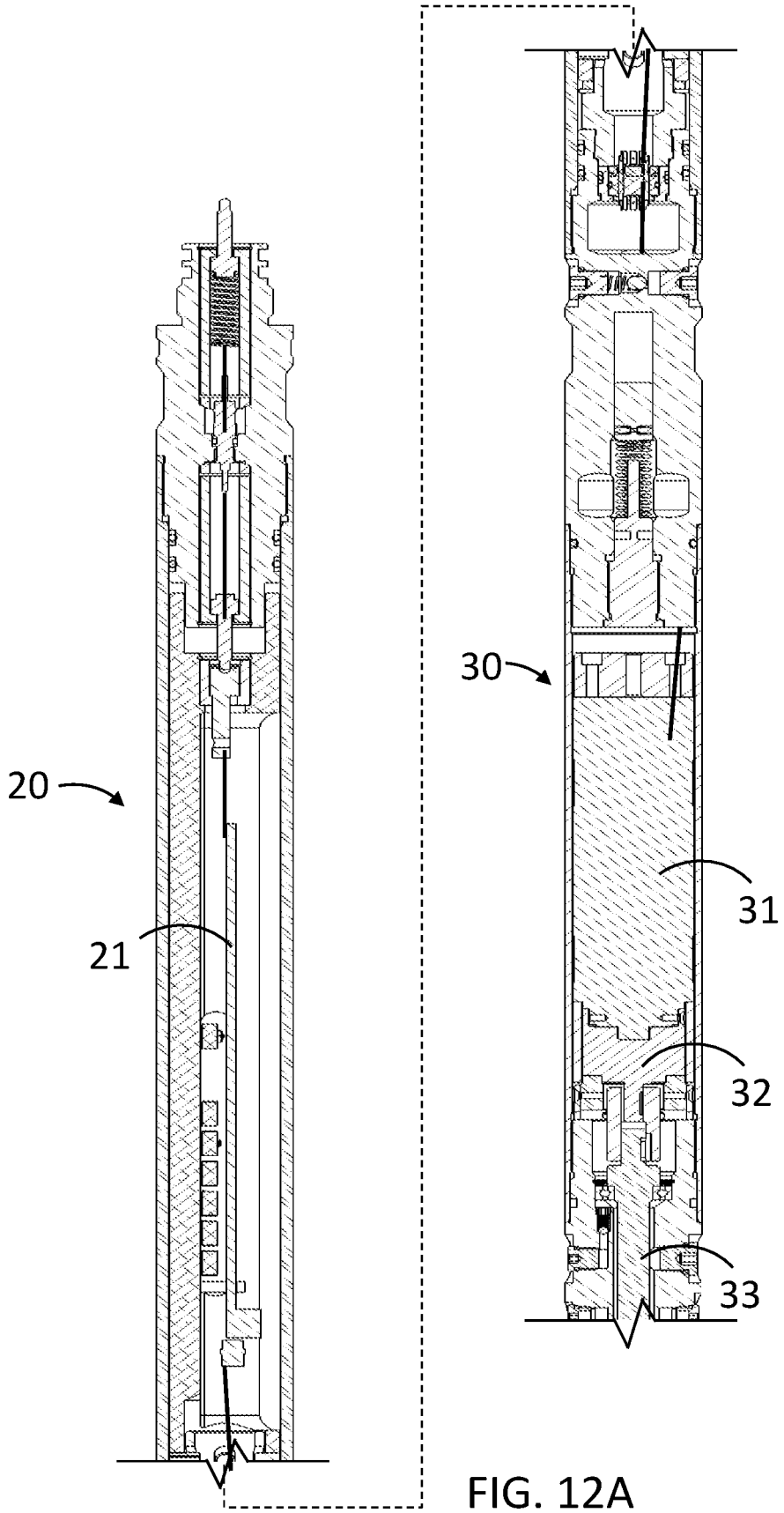
FIGS. 12A, 12B and 12C are cross-sectional partial views of another embodiment of a multi-stage reciprocating pump downhole tool.
Figure 12B:
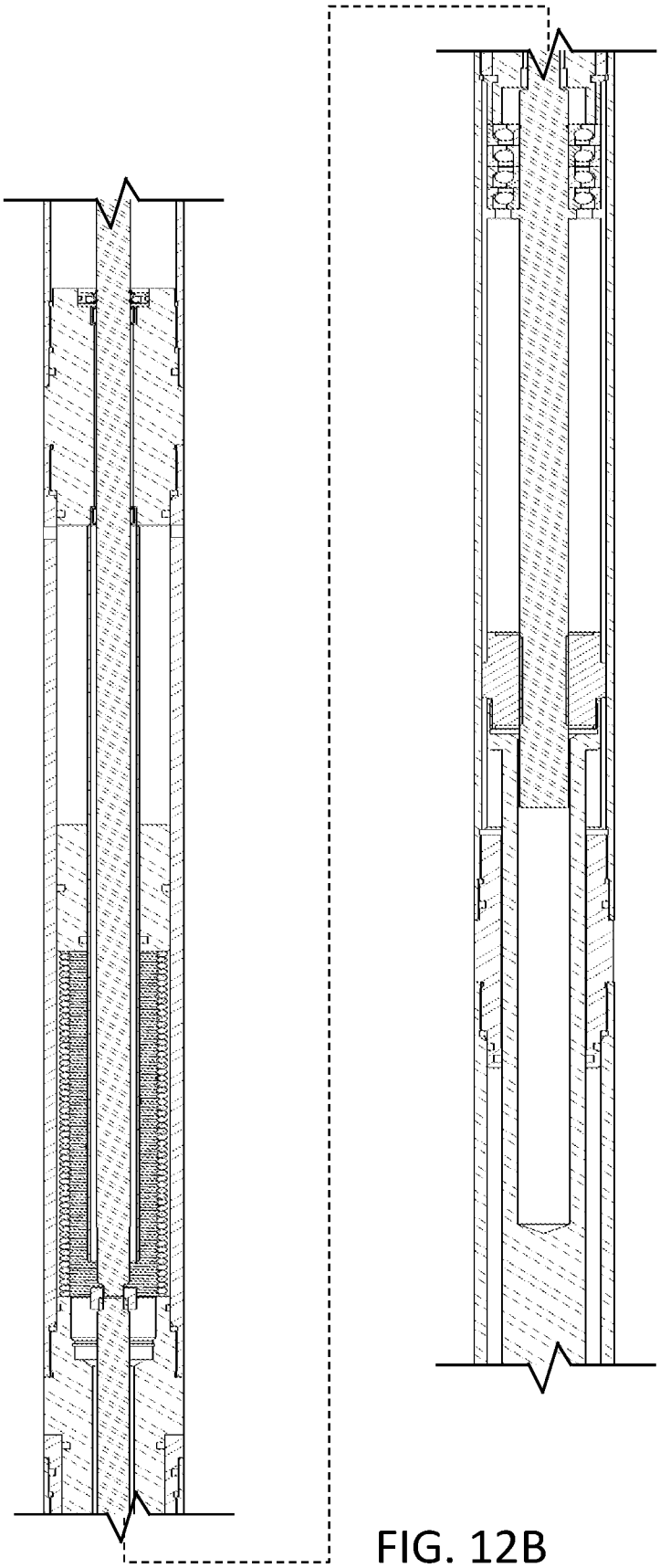
Figure 12C:
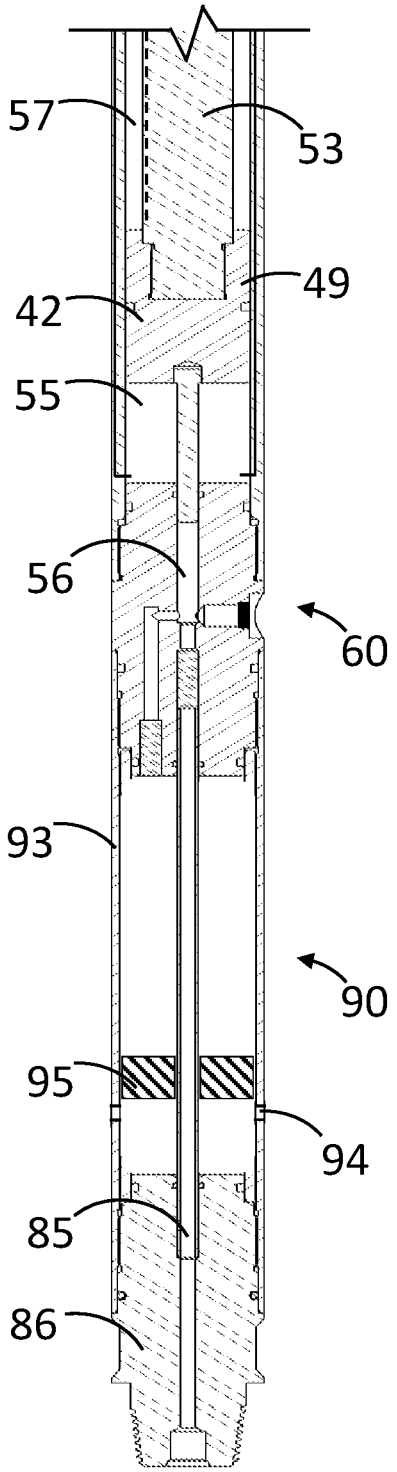

FIGS. 12A-12C are cross-sectional partial views of an embodiment of a multi-stage reciprocating pump downhole tool in which the fluid source is pump fluid contained in a reservoir module 90. The reservoir module 90 comprising; a reservoir outer housing 93, a reservoir inner body 95 isolating reservoir fluid within the reservoir outer housing 93 from well fluid allowed to communicate through one or more ports 94 in the reservoir outer housing 93, and a flow through tube 85 enabling fluid communication through the hydraulic control module 60 from the pressure chambers 55 and 56 to the exterior of the lower side of the bottom sub 86. As fluid is drawn into the pump chambers 55 and 56 and pumped through the flow-through tube 85 of the reservoir module 90, borehole pressure acts on the reservoir inner body 95 through the one or more ports 94 in the reservoir outer housing 93 to provide a priming pressure to the pump chambers 55 and 56, via the hydraulic control module 60.

Figure 13A:
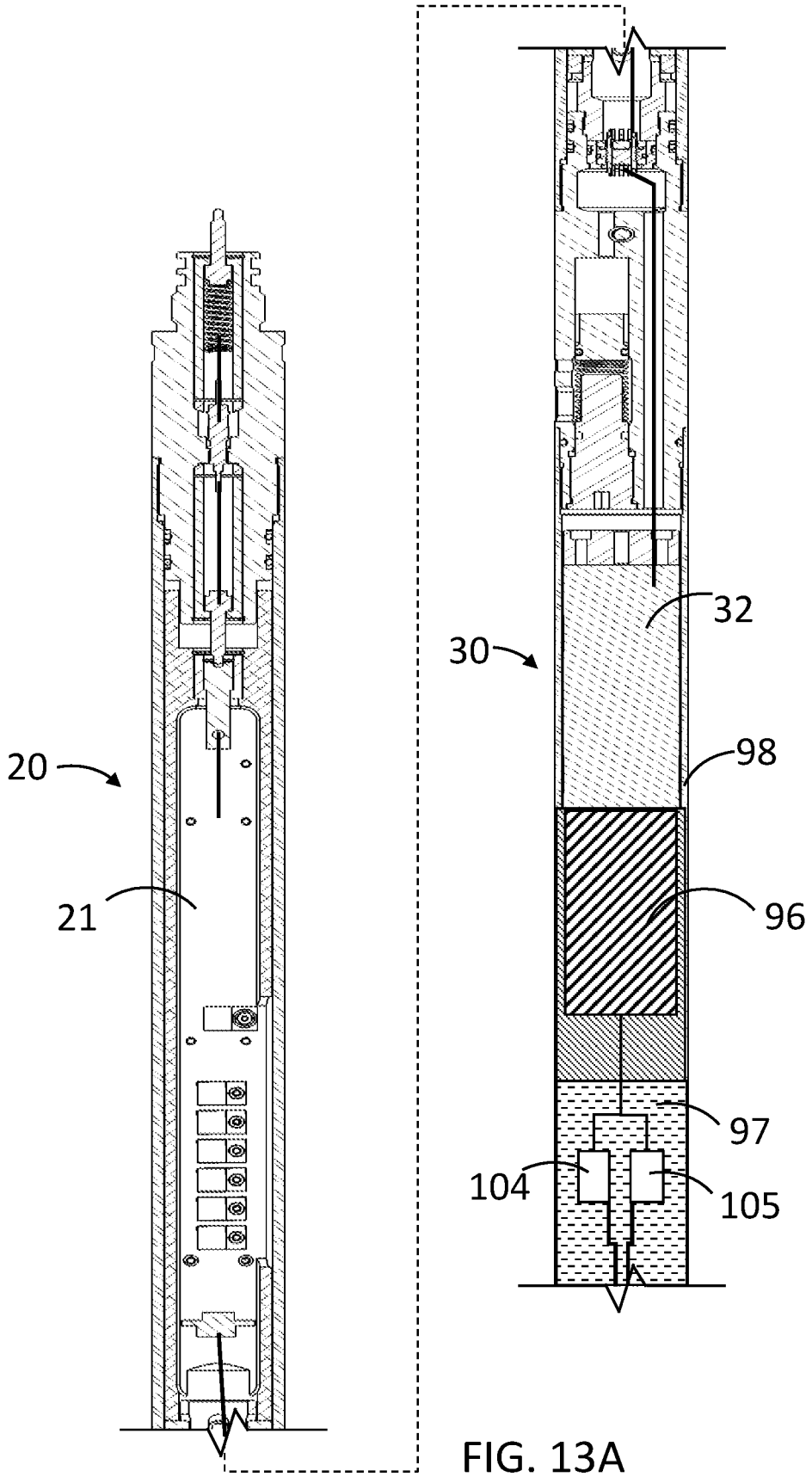
FIGS. 13A, 13B, and 13C are cross-sectional partial views of another embodiment of a multi-stage reciprocating pump downhole tool.
Figure 13B:
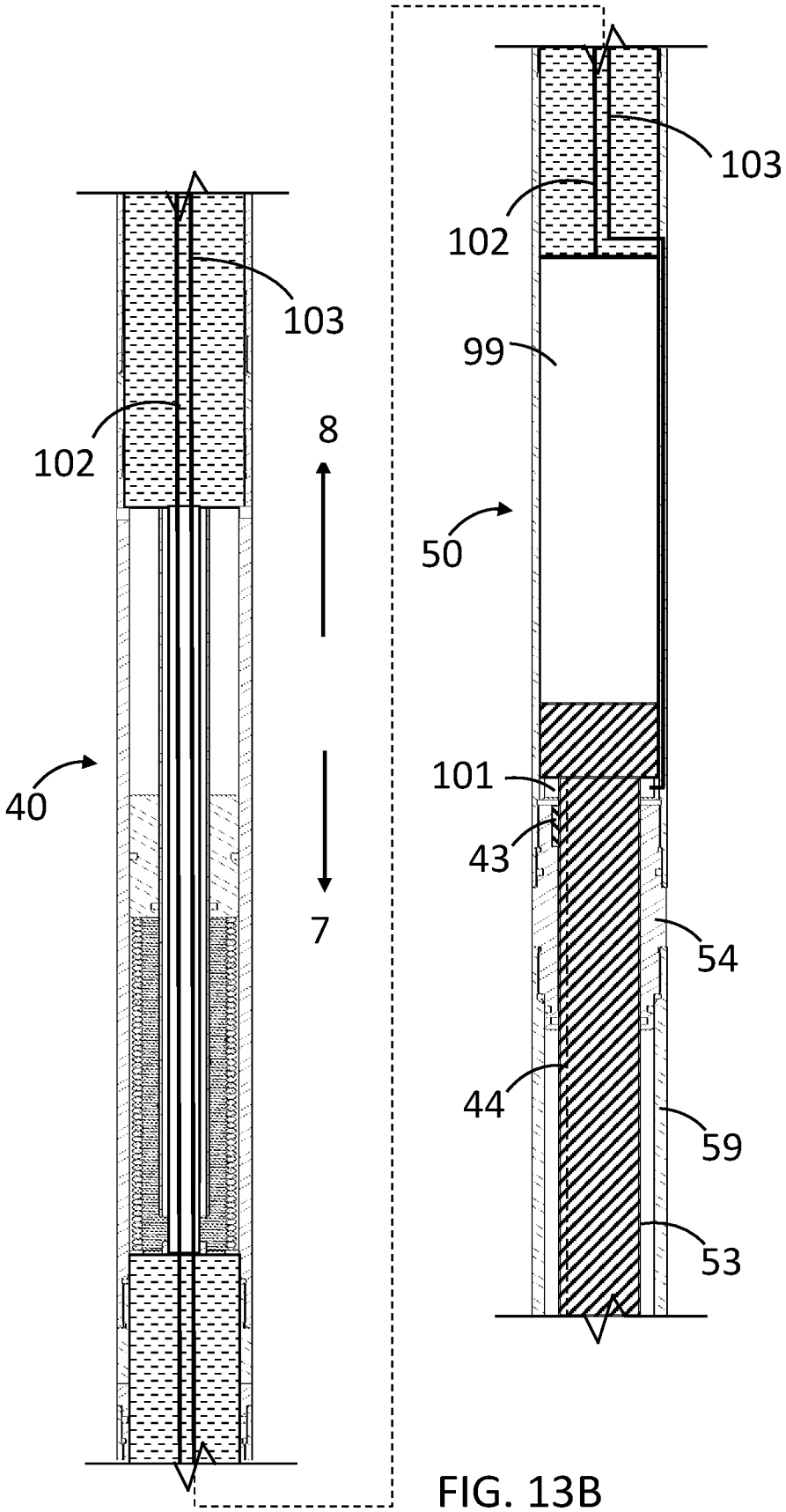
Figure 13C:
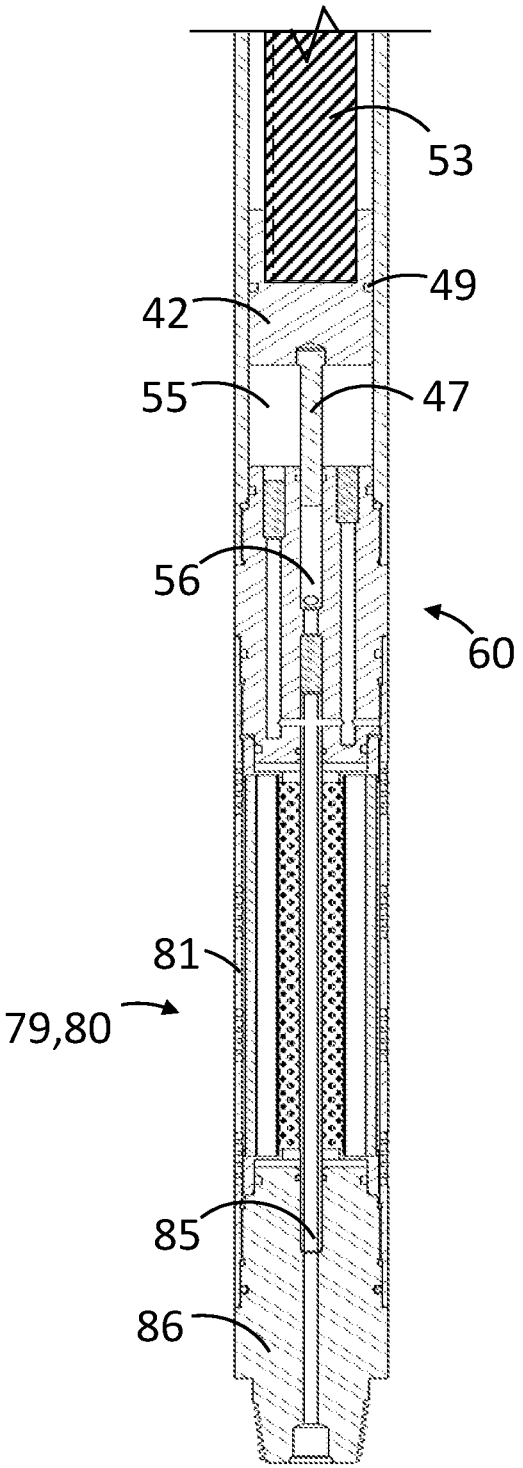

FIGS. 13A and 13C are cross-sectional partial views of another embodiment of a multi-stage reciprocating pump downhole tool. In this embodiment the actuator of the linear actuator module is hydraulic and additionally comprises a hydraulic pump 96, solenoid valve control block 97, hydraulic pump housing 98, actuation chamber 99 and retraction chamber 101. The piston body 42 comprising the large surface area piston and the small surface area piston is disposed at a distal end of the extension member 53 and each disposed to translate within a low-pressure chamber 55 and high-pressure chamber 56, respectively. The hydraulic pump 96 resides in a pump housing 98 and provides pressurized hydraulic fluid to the solenoid valve control block 97. An actuation fluid passageway extends 102 from the solenoid valve control block 97 to the actuation chamber 99 on the uphole side of the extension member 53 and a retraction fluid passageway 103 extends from the solenoid valve control block 97 to the retraction chamber 101. When the hydraulic pump 96 pressurizes the retraction chamber 101 by control of the solenoid valve block 97, the piston body 42 is translated in the uphole direction and fluid is drawn into the pressure chambers 55 and 56 form the fluid source and through the fluid control module 60. When the hydraulic pump 96 pressurizes the actuation chamber 99 by control of the solenoid valve block 97, the piston body 42 is translated in the downhole direction, fluid is pumped out of the pressure chambers 55 and 56, through the fluid control module 60 and out of the downhole tool through the fluid source 79. Optionally, a compression spring may reside in the retraction chamber 101 to push the extension piston in the uphole direction to create a suction to draw fluid into the pressure chambers 55 and 56.

Where the actuator is mechanical (see FIG. 3A-3C) the controller 21 may, for example, operate to control the operation of the electrical motor 31 to maintain a desired rotational speed of the rotary screw 51 thereby controlling the intake and output flowrate of the downhole tool 90. Additionally, the controller 21 may control the number of rotations and rotational direction of the electrical motor 31, thereby precisely controlling the position and direction of the piston body 42.

Where the actuator is hydraulic (see FIG. 13A-13C), the controller 21 may, for example operate to control the operation of the electrical motor 31 to maintain a desired pressure and volume of hydraulic fluid within the actuation and retraction chambers 99 and 101, respectively. Additionally, pressure sensors 26 and 27 (see FIG. 16) may be disposed within in the actuation chamber 99 and retraction chamber 101 to provide a signal to the controller 21, such that the controller 21 may control the operation of the electrical motor 31 based on the monitored parameters. Additionally, the controller 21 may receive a signal provided from the electrical motor 31 to the control module 20 to control the operation of the hydraulic pump 96 to prevent the monitored parameters from exceeding a setpoint value of one or more parameters; for example, torque and speed of the electrical motor 31. Additionally, where the actuator is hydraulic, the controller 21 may, for example control the state of one or more solenoid valves within the solenoid valve control block 97; for example, solenoid valve 104 which controls the flow of fluid to actuation chamber 99, via actuation passage 102, and solenoid valve 105, which controls the flow of fluid to retraction chamber 101 via retraction passage 103

Figure 14:
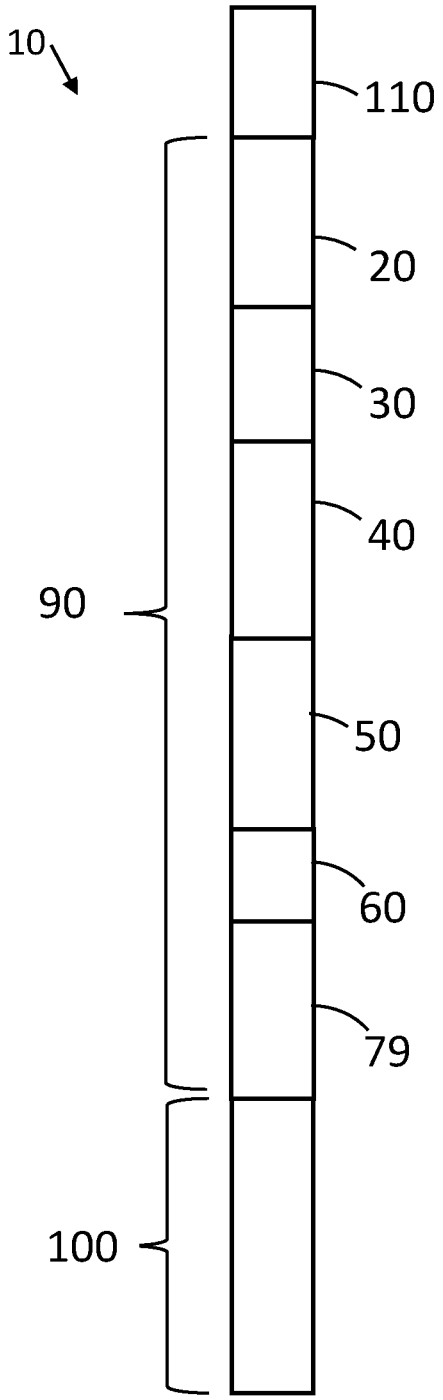
FIG. 14 is a block diagram of the modules of a bottom hole assembly.

In an embodiment (see FIG. 14), the BHA 10 may include a battery 110 that provides electrical power to the electrical motor 31 and controller 21. The controller 21 is responsible for control of the electrical motor 31, that operates the rotary screw 51. The controller 21 may implement control logic that is based, without limitation, on one or more inputs, such as a pressure sensor signal, a temperature signal, an accelerometer signal, a wireline cable tension signal provided by a tension sensor 28 (see FIG. 16), an electrical current sensor signal, or a control command received through the wireline cable 5.

Where the actuator is hydraulic, the controller 21 is responsible for control of the electrical motor 31, that operates the hydraulic pump 96. The controller 21 may implement control logic that is based, without limitation, on one or more inputs, such as a pressure sensor signal, a temperature signal, an accelerometer signal, a wireline cable tension signal, an electrical current sensor signal, or a control command received through the wireline cable 5.

Figure 15:
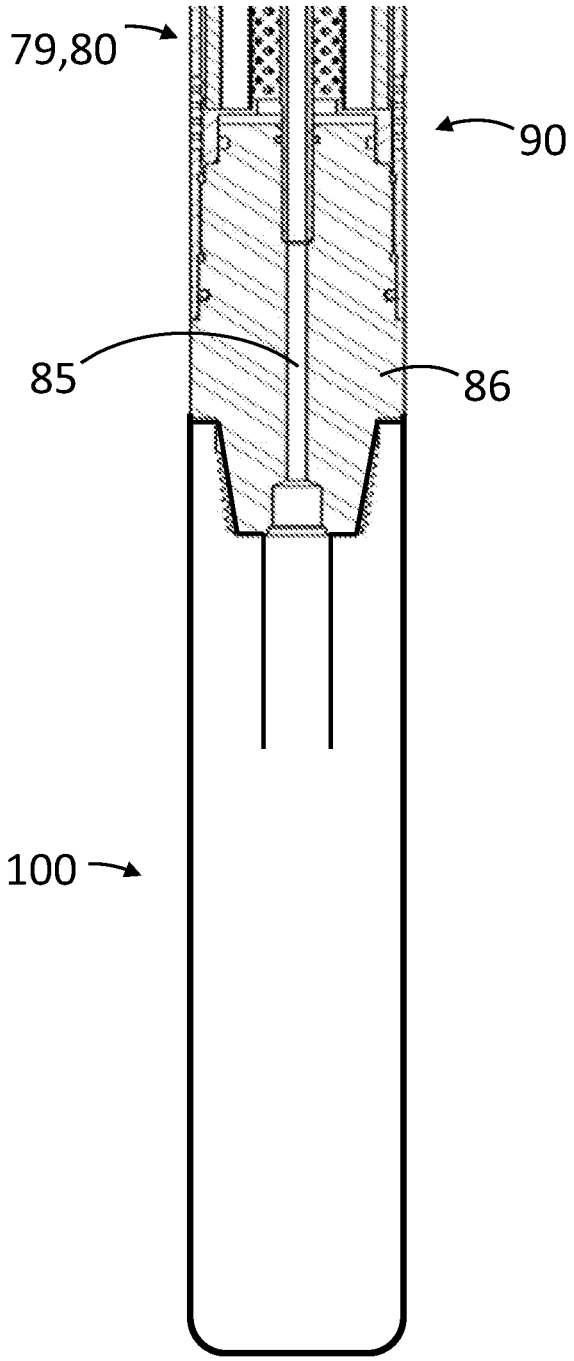
FIG. 15 is a cross-sectional partial view of a multi-stage-stage reciprocating pump downhole tool connected to an isolation tool.

FIG. 15 is a partial view of a BHA showing an isolation tool 100 secured to the downhole end of the bottom sub 86 and disposed to receive pressurized fluid from the downhole tool 90.

In an embodiment of a method, the piston body 42 is reciprocated within the linear actuator housing 59 from the uphole end of the extension piston housing 59 near key sub 54, to the downhole end of the extension piston housing 59 near the hydraulic control module 60, this reciprocation may be continued until a desired volume of fluid at a desired pressure is achieved within the isolation tool 100.

In an embodiment, the isolation tool 100 is and inflatable packer.

In an embodiment, the isolation tool 100 is an inflatable straddle packer.

In an embodiment, the isolation tool 100 is bridge plug.

In an embodiment, the isolation tool 100 is a production packer

In an embodiment, the isolation tool 100 is a permanent packer.

In an embodiment, the isolation tool 100 is a cement retainer.

In an embodiment, the isolation tool 100 is a frac plug.

Figure 16:
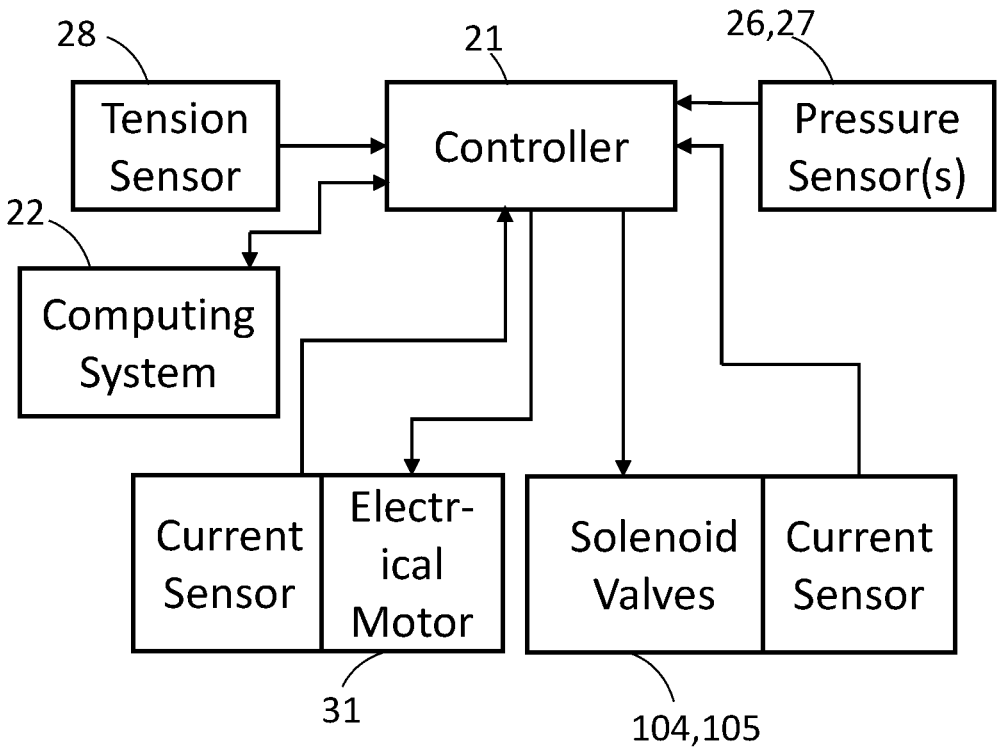
FIG. 16 is a schematic diagram of a control system for controlling operation of a multi-stage reciprocating pump downhole tool.

FIG. 16 is a schematic diagram of a control system for controlling operation of the downhole tool 90. While the diagram shows the on-board controller 21 as the only controller, the computing system 22 (see also FIG. 2A-2C) on the uphole end of the wireline cable may perform some or all of the functions attributed here to the on-board controller 21. Furthermore, the computing system 22 may provide control signals to the on-board controller 21 indicating when the downhole tool 90 should initiate certain processes, such as starting to reciprocate the piston body 42 to pump fluid out of the downhole tool 90 or stopping the reciprocation of the piston body 42 to stop pumping fluid out of the downhole tool 90, for example when an isolation tool 100 is disposed to receive fluid from the downhole tool 90 (see FIG. 15), during the pressurization of an isolation tool 100 or after the downhole tool 90 has disconnected from an isolation tool 100.

Figure 17:
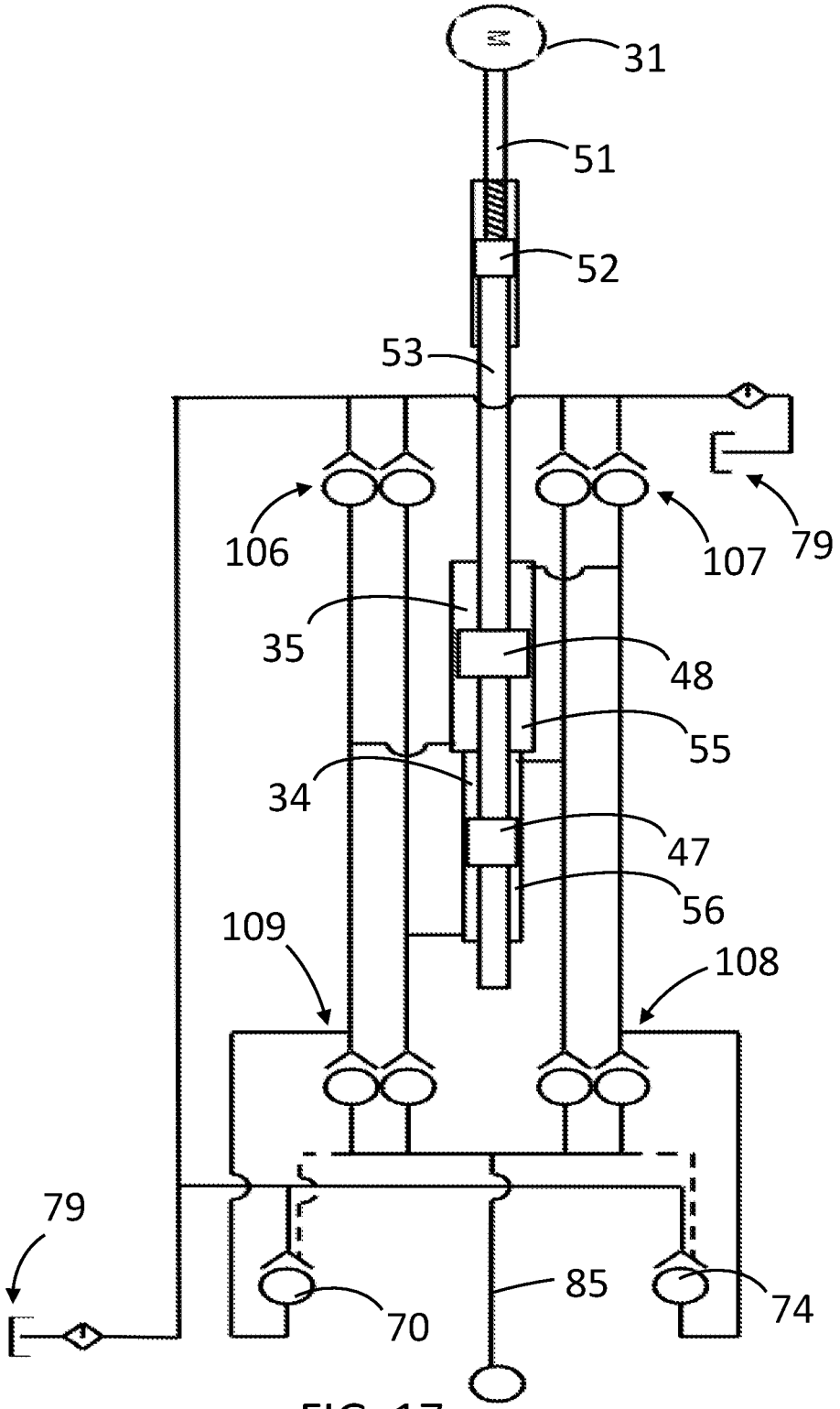
FIG. 17 is a schematic of the hydraulic and actuation system of a multi-stage reciprocating pump downhole tool.

FIG. 17 is a schematic of an actuation and hydraulic system of a multi-stage reciprocating pump downhole tool. High pressure piston 47 isolates high pressure chamber 56 from return chamber 34. Low pressure piston 48 isolates return chamber 35 from low pressure chamber 55. Both high pressure piston 47 and low pressure piston 47 are disposed at a distal end of extension member 53 actuated by rotary screw 51, threaded nut 52 and electrical motor 31. Fluid is drawn into return chambers 35 and 34 during translation of the pistons 48 and 47, respectively, through return chamber intake check valve set 107 from fluid source 79, as fluid is delivered out of pressure chambers 55 and 56 via pressure chamber output check valve set 109. Fluid is drawn into pressure chambers 55 and 56 during translation of the pistons 48 and 47, respectively, through pressure chamber intake check valve set 106 from fluid source 79, as fluid is delivered out of return chambers 34 and 35 via return chamber output check valve set 108. Pilot operated check valve 70 is disposed to allow fluid flow from pressure chamber 55 to flow to the fluid source 79 when output pressure into flow-through passage 85 exceeds the pilot pressure of the pilot operated check valve 70. Pilot operated check valve 74 is disposed to allow fluid flow from return chamber 35 to flow to the fluid source 79 when output pressure into flow-through passage 85 exceeds the pilot pressure of the pilot operated check valve 74.

Figure 18:
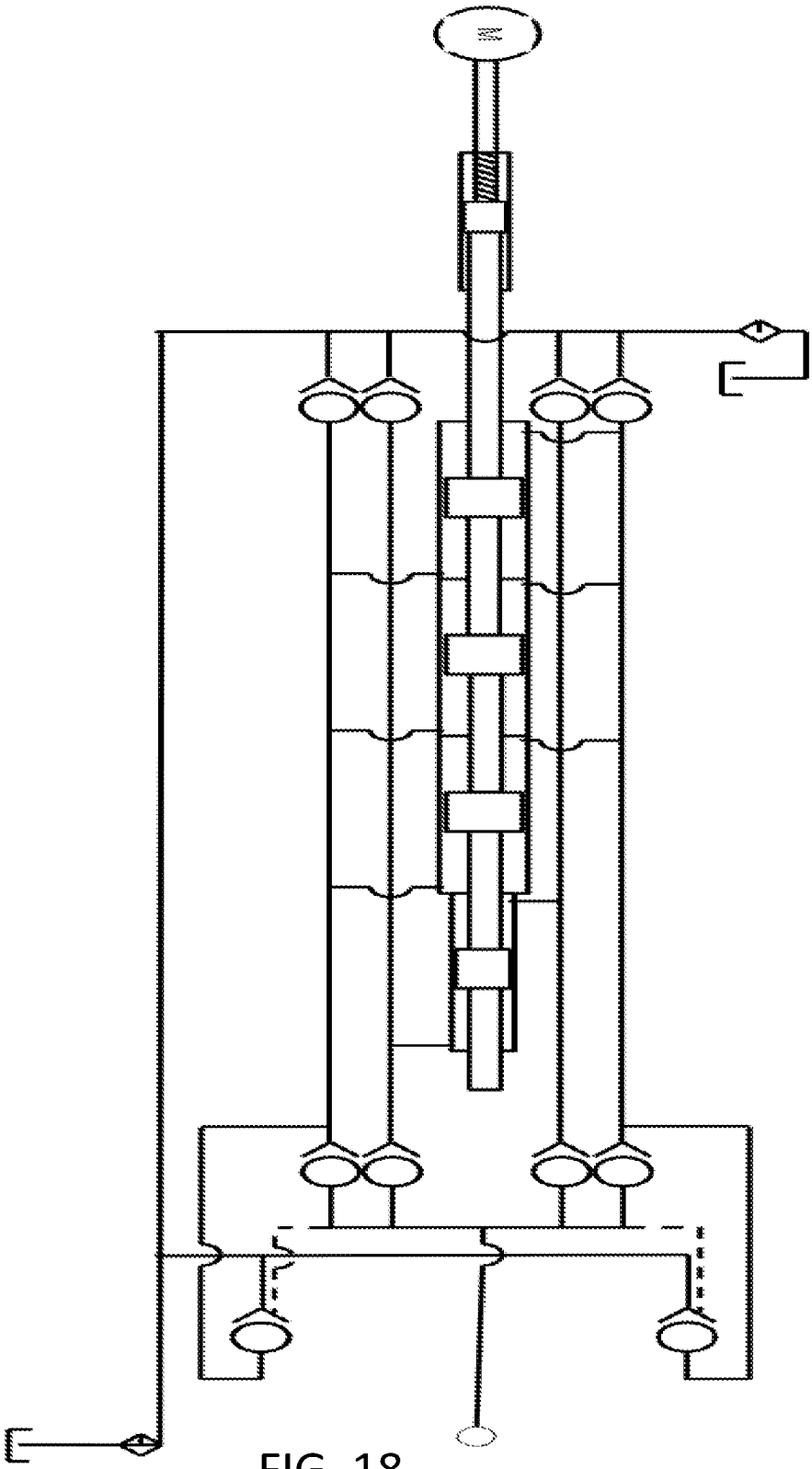
FIG. 18 is a schematic of another embodiment of the hydraulic and actuation system of a multi-stage reciprocating pump downhole tool of FIG. 17, comprising two additional pistons, associated chambers and associated features.

FIG. 18 is a schematic of an actuation and hydraulic system of a multi-stage reciprocating pump downhole tool of FIG. 17 comprising two additional low-pressure pistons and associated pressure and return chambers.

The disclosed apparatus, a multi-stage reciprocating pump downhole tool, enables the provision of fluid while utilizing available power in an optimal and efficient technique. This is achieved by automatically reducing the flow rate of the provided fluid. Additionally, the disclosed apparatus enables an automatic reset to the original higher flowrate capability state of the apparatus, prior to a high-pressure demand, upon a demand of fluid below a setpoint pressure, or no demand of fluid pressure.

The disclosed methods enable the isolation of a borehole section in an operationally rapid and efficient manner. This is achieved by providing a bottom hole assembly including an isolation tool and a multi-stage reciprocating pump; the multi-stage reciprocating pump automatically reducing the flow rate of the provided fluid to an isolation tool demanding a pressure of fluid above a setpoint pressure and the multi-stage reciprocating pump downhole tool automatically resetting to the original higher flowrate capability state of the tool, prior to the high pressure demand from the isolation tool, upon a demand of fluid below a setpoint pressure, or no demand of fluid pressure.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment. The term "seal", as in the engaging of a sealing element to a borehole, is used for the purpose of describing particular embodiments. The term "seal" should not be limited in scope to a perfect seal and may be a partial seal.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

The invention claimed is:

1. A bottom hole assembly for use within a borehole that extends into a subterranean formation, comprising:

a multi-stage reciprocating pump downhole tool including an actuator and a piston body disposed at an end of the actuator;

an output hydraulic passage;

a fluid source;

a first and second pressure chamber disposed to intake fluid from the fluid source during an actuation of the actuator and deliver fluid to the output hydraulic passage during an opposite actuation of the actuator; and a hydraulic control circuit disposed to divert the flow direction from the first pressure chamber when the pressure of the second pressure chamber reaches a setpoint pressure and revert the flow direction from the first pressure chamber when the pressure of the second pressure chamber is reduced below the setpoint pressure.

2. The bottom hole assembly of claim 1, further comprising:

an isolation tool disposed to receive fluid from the output hydraulic passage.

3. The bottom hole assembly of claim 1, wherein the hydraulic control circuit includes a pilot operated check valve.

4. The bottom hole assembly of claim 1, wherein the setpoint pressure is equal to or greater than the pilot pressure of a pilot operated check valve.

5. The bottom hole assembly of claim 1, wherein the setpoint pressure is greater than or equal to 200 psi.

6. The bottom hole assembly of claim 1, wherein the setpoint pressure is greater than the pressure required to inflate the isolation tool and less than a pressure required to fully set the isolation tool.

7. The bottom hole assembly of claim 1, wherein the hydraulic control circuit is disposed to reduce the flowrate of fluid to the isolation tool demanding a pressure of fluid above a setpoint pressure and automatically reset to the original higher flowrate capability state, prior to the high pressure demand from the isolation tool, upon a demand of fluid below a setpoint pressure, or no demand of fluid pressure.

8. The bottom hole assembly of claim 1, further comprising an electrical motor.

9. The bottom hole assembly of claim 8, further comprising:

a controller in electronic communication with the electrical motor for controlling the electric motor.

10. The bottom hole assembly of claim 8, wherein the actuator is mechanical, further comprising:

a rotary screw;

a threaded body secured to an end of the actuator and restricted from rotational motion;

the rotary screw threaded through the threaded body, wherein rotating the rotary screw in a first direction actuates the actuator and rotation of the rotary screw in a second direction actuates the actuator in the opposite direction;

the electrical motor coupled to operate the rotary screw.

11. The bottom hole assembly of claim 8, wherein the actuator is hydraulic, further comprising:

a first and second actuator piston chamber;

a hydraulic pump in fluid communication with the first and second actuator piston chamber and disposed to deliver fluid to the first piston chamber to actuate the actuator and to the second piston chamber to actuate the actuator in the opposite direction;

the electric motor coupled to operate the hydraulic pump.

12. The bottom hole assembly of claim 1, further comprising:

one or more return chambers disposed to deliver fluid to the output hydraulic passage during the actuation of the actuator and intake fluid from the fluid source during the opposite actuation of the actuator;

the hydraulic control circuit further disposed to divert the flow direction from the one or more return chambers when the pressure of one or more distinct chambers reaches a setpoint pressure, and revert the flow direction from the one or more return chambers when the pressure of the one or more distinct chambers is reduced below the setpoint pressure.

13. The bottom hole assembly of claim 12, further comprising an electrical motor.

14. The bottom hole assembly of claim 13, further comprising:

a controller in electronic communication with the electrical motor for controlling the electrical motor.

15. The bottom hole assembly of 12, wherein the hydraulic control circuits comprise two or more pilot operated check valves; the pilot pressure of each pilot operated check valve differs.

16. The bottom hole assembly of claim 12, further comprising:

an isolation tool disposed to receive fluid from the output hydraulic passage.

17. The bottom hole assembly of claim 13, wherein the actuator is mechanical, the bottom hole assembly further comprising;

a rotary screw;

a threaded body secured to an end of the actuator and restricted from rotational motion;

a rotary screw threaded through the threaded body, wherein rotating the rotary screw in a first direction actuates the actuator and rotation of the rotary screw in a second direction actuates the actuator in the opposite direction;

the electric motor coupled to operate the rotary screw.

18. The bottom hole assembly of claim 13, wherein the actuator is hydraulic, further comprising:

a first and second actuator piston chamber;

a hydraulic pump in fluid communication with the first and second actuator piston chamber and disposed to deliver fluid to the first piston chamber to actuate the actuator and to the second piston chamber to actuate the actuator in the opposite direction;

the electric motor coupled to operate the hydraulic pump.

19. A method of delivering fluid from a downhole tool, the method comprising:

deploying the downhole tool within a borehole;

actuating a piston body in a first direction;

intaking fluid into a first and second pressure chamber from a fluid source;

actuating the piston body in a second direction;

delivering the fluid to an output hydraulic passage;

repeating the actuation of the piston body in the first and second direction to repeatedly intake fluid into the first and second pressure chamber from the fluid source and deliver fluid to the output hydraulic passage;

diverting flow from the first pressure chamber when a setpoint pressure is reached in the second pressure chamber;

reverting the flow from the first pressure chamber when the pressure of the second pressure chamber is reduced below the setpoint pressure.

20. A method of isolating a portion of a borehole, the method comprising the steps of:

deploying a bottom hole assembly including a downhole tool and an isolation tool within a borehole;

positioning the bottom hole assembly near or within a tubular segment such that the isolation tool is in a position to isolate portions of the borehole upon pressurization;

activating the downhole tool to actuate a piston body therein, in a first direction to intake fluid into a first and second pressure chamber from a fluid source, and actuate the piston body in a second direction to pressurize the fluid, and deliver the fluid to an output hydraulic passage;

repeating the actuation of the piston body in the first and second direction to repeatedly intake fluid into the first and second pressure chamber from the fluid source and deliver the fluid to the output hydraulic passage and to the isolation tool to a predetermined pressure limit;

the downhole tool automatically reducing its output flowrate and increasing its pressure output upon the isolation tool reaching the predetermined pressure limit by diverting flow from the first pressure chamber when a setpoint pressure is reached in the second pressure chamber;

further pressurizing the isolation tool at the reduced flowrate and increased pressure;

isolating a portion of the borehole above the isolation tool from a portion of the borehole below the isolation tool;

disconnecting the isolation tool;

the downhole tool automatically resetting to provide flow at a pressure below the predetermined pressure limit upon a reduction of pressure in the output passage below the predetermined pressure limit by reverting the flow from the first pressure chamber when the pressure of the second pressure chamber is reduced below the setpoint pressure.

21. A method of delivering fluid to an isolation tool, the method comprising the steps of:

deploying a bottom hole assembly including a downhole tool and an isolation tool within the borehole;

positioning the bottom hole assembly near or within a tubular segment such that the isolation tool is in a position to isolate the desired portions of the borehole upon pressurization;

activating the downhole tool to actuate a piston body therein, in a first direction to intake fluid into a first and second pressure chamber from a fluid source, and actuate the piston body in a second direction to pressurize and deliver the fluid to an output hydraulic passage;

repeating the actuation of the piston body in the first and second direction to repeatedly intake fluid into the first and second pressure chamber from the fluid source and deliver the fluid to the output hydraulic passage and to the isolation tool;

reducing the flow rate of the provided fluid to the isolation tool demanding a pressure of fluid above a setpoint pressure and the downhole tool automatically resetting to the original higher flowrate capability state of the tool, prior to the high pressure demand from the isolation tool, upon a demand of fluid below a setpoint pressure, or no demand of fluid pressure.

22. The method of claim 19 wherein, the fluid source is a fluid volume in the interior of a housing in fluid communication with the borehole.

23. The method of claim 19 wherein, the fluid source is a reservoir module.

24. The method of claim 20, wherein the predetermined pressure limit is greater than the pressure required to inflate the isolation tool and less than a pressure required to fully set the isolation tool.

25. The method of claim 20, wherein the predetermined pressure limit is greater than or equal to 200 psi.

* * * * *